US008261568B2

(12) United States Patent
Reifel et al.

(10) Patent No.: US 8,261,568 B2
(45) Date of Patent: Sep. 11, 2012

(54) CONDENSING GAS PACKAGE UNIT WITH A TUBULAR CONDUIT FOR PASSING A CONDENSATE DRAIN LINE

(75) Inventors: Allan J. Reifel, Florissant, MO (US); Russell W. Hoeffken, Millstadt, IL (US); David W. Garvin, Troy, MO (US)

(73) Assignee: Nordyne LLC, O'Fallon, MO (US)

( * ) Notice: Subject to any disclaimer, the term of this patent is extended or adjusted under 35 U.S.C. 154(b) by 0 days.

(21) Appl. No.: 13/026,003

(22) Filed: Feb. 11, 2011

(65) Prior Publication Data

US 2012/0047935 A1 Mar. 1, 2012

(51) Int. Cl.
*F25D 21/14* (2006.01)

(52) U.S. Cl. ..... 62/285

(58) Field of Classification Search ..... 62/150, 62/80, 272, 285, 260, DIG. 16, 82, 277; 126/112, 126/113

See application file for complete search history.

(56) References Cited

U.S. PATENT DOCUMENTS

| | | | |
|---|---|---|---|
| RE24,295 | E | 3/1957 | Johnson |
| 4,449,511 | A | 5/1984 | Hayes et al. |
| 4,479,482 | A | 10/1984 | Cherington |
| 4,543,892 | A | 10/1985 | Tomlinson et al. |
| 4,682,579 | A | 7/1987 | Bigham |
| 4,706,884 | A | 11/1987 | Brauer |
| 4,730,600 | A | 3/1988 | Harrigill |
| 4,779,676 | A | 10/1988 | Harrigill |
| 4,867,673 | A | 9/1989 | Harrigill |
| 4,924,848 | A | 5/1990 | Vaughn |
| 5,178,124 | A | 1/1993 | Lu et al. |
| 5,271,376 | A | 12/1993 | Lu et al. |
| 5,292,280 | A | 3/1994 | Janu et al. |
| 5,341,795 | A | 8/1994 | Chou et al. |
| 5,749,355 | A | 5/1998 | Roan et al. |
| 5,992,410 | A | 11/1999 | Raleigh et al. |

(Continued)

FOREIGN PATENT DOCUMENTS

EP 2163830 A2 3/2010

(Continued)

OTHER PUBLICATIONS

ISR and Written Opinion for corresponding Int'l Application No. PCT/US2011/047491 filed Aug. 11, 2011.

*Primary Examiner* — Cheryl J Tyler
*Assistant Examiner* — Ignacio E. Landeros
(74) *Attorney, Agent, or Firm* — Bryan Cave LLP

(57) ABSTRACT

Air conditioning units packaged with condensing gas heat exchangers include a drain line connected to a collector attached to the heat exchanger. In different embodiments, the drain line, or a conduit for the drain line, may extend to the return duct opening for routing of the drain line through the return duct for disposal of the condensate, for instance, within the building, or the drain line may extend through a hole in the floor of the unit. The conduit may protect the drain line from direct heat from the heat exchanger, from freezing where the drain line passes through an outdoor section, or both. In some embodiments, air may be circulated through the conduit to prevent freezing. The conduit may guide the drain line through the unit, roof curb assembly, or roof, or the drain line may be routed through the unit by the manufacturer to the return duct opening.

18 Claims, 21 Drawing Sheets

U.S. PATENT DOCUMENTS

| | | | | |
|---|---|---|---|---|
| 6,684,878 | B2 * | 2/2004 | Ho et al. | 126/110 R |
| 7,036,498 | B2 | 5/2006 | Riepenhoff et al. | |
| 2001/0013404 | A1 | 8/2001 | Lagace et al. | |
| 2009/0308566 | A1 | 12/2009 | Simka | |
| 2010/0122806 | A1 | 5/2010 | Halgash | |
| 2011/0174202 | A1 | 7/2011 | Gedcke et al. | |
| 2012/0048521 | A1 | 3/2012 | Reifel et al. | |

FOREIGN PATENT DOCUMENTS

| | | | |
|---|---|---|---|
| EP | 2196390 | A1 | 6/2010 |
| JP | 2010112659 | A * | 5/2010 |
| WO | 9010828 | A1 | 9/1990 |

* cited by examiner

CONDENSING GAS PACKAGE UNIT WITH A TUBULAR CONDUIT FOR PASSING A CONDENSATE DRAIN LINE

RELATED PATENT APPLICATIONS

This patent application is related to two other United States non-provisional patent applications filed on the same day, having at least three inventors in common, having a common assignee, and having the same drawings, brief description of the drawings section, and detailed description of examples of embodiments section, but having different claims, summary of the invention sections, abstracts, and titles. These two other patent applications are titled: "CONDENSING GAS PACKAGE UNIT FOR ROOF OR GROUND INSTALLATION, COLLECTOR, AND CONDENSATE DRAIN APPARATUS" and "CONDENSING GAS PACKAGE UNIT CONFIGURED TO DRAIN CONDENSATE THROUGH INDUCER FAN AND METHOD OF REDUCING FUEL CONSUMPTION." Further, to the extent not already included herein, the contents of both of these other two patent applications are incorporated herein by reference.

FIELD OF THE INVENTION

This Invention relates to heating, ventilating, and air conditioning (HVAC) equipment and furnaces, and in particular, gas package units and condensing furnaces.

BACKGROUND OF THE INVENTION

Heating, ventilating, and air conditioning (HVAC) equipment has been used to heat, cool, and ventilate buildings and other enclosed spaces where people live and work. Air conditioning units have been used to provide cooling in the summer months. In addition, furnaces have been packaged separately and with air conditioning units and the furnaces have been operated in the winter months to provide heating. Furthermore, condensing furnaces have been used to reduce consumption of fossil fuels (e.g., natural gas or propane) burned in furnaces to provide heating. Condensing gas furnaces, however, have typically been located indoors. In such installations, condensate was typically drained into a sewer in a conventional manner. Many buildings, however, are configured to have an HVAC unit installed on the roof of the building or on the ground outside the building. In the past, such applications have typically not permitted use of a condensing furnace because condensate from the furnace would freeze when local ambient temperatures were below freezing. Frozen condensate would interfere with continued operation of the unit, collect causing a hazard or nuisance, or a combination thereof.

A number of reasons exist to reduce consumption of fossil fuels. These reasons may include, as examples, reducing fuel bills for the building owner, reducing greenhouse gas (e.g., carbon dioxide) production, reducing emissions of traditional pollutants such as carbon monoxide, hydrocarbons, and oxides of nitrogen, reducing dependency on limited fossil fuel reserves, reducing dependency on foreign sources of fossil fuels, reducing environmental damage and risk associated with extraction of fossil fuels, and qualifying for government incentives designed to reduce consumption of fossil fuels. Since many buildings are configured for HVAC units that are located outdoors, conversion of outdoor gas package units to condensing gas package units has the potential to significantly reduce consumption of fossil fuels. Consequently, needs or potential for benefit exist for equipment, apparatuses, and methods that allow condensing gas furnaces to be installed and used outdoors. In particular, needs or potential for benefit exist for equipment, apparatuses, and methods that prevent problems that result from the freezing of condensate from condensing furnaces that are installed outdoors. Needs or potential for benefit exist for equipment, apparatuses, and methods that prevent frozen condensate from interfering with continued operation of the HVAC unit, from collecting, from causing a hazard or nuisance, or a combination thereof, as examples.

Outdoor condensing gas furnaces have previously been contemplated and condensate drain lines for such units have been routed to avoid freezing. U.S. Pat. No. 6,684,878 (Ho et al.) illustrates an example. For various reasons, however, prior art outdoor condensing (e.g., gas) furnaces have not successfully been mass produced. Condensing gas furnaces, means and methods of disposing of condensate from gas furnaces, and devices that make such equipment and systems possible for outdoor installations are needed or would be beneficial that are sufficiently reliable, inexpensive, and easy to install and service so as to be practical in a mass-production context. Needs or potential for benefit or improvement exist for methods of manufacturing condensing gas package units, HVAC equipment and HVAC units having condensing furnaces, and systems and buildings having such devices. Other needs or potential for benefit or improvement may also be described herein or known in the HVAC or fossil fuel industries. Room for improvement exists over the prior art in these and other areas that may be apparent to a person of ordinary skill in the art having studied this document.

Figure 1:
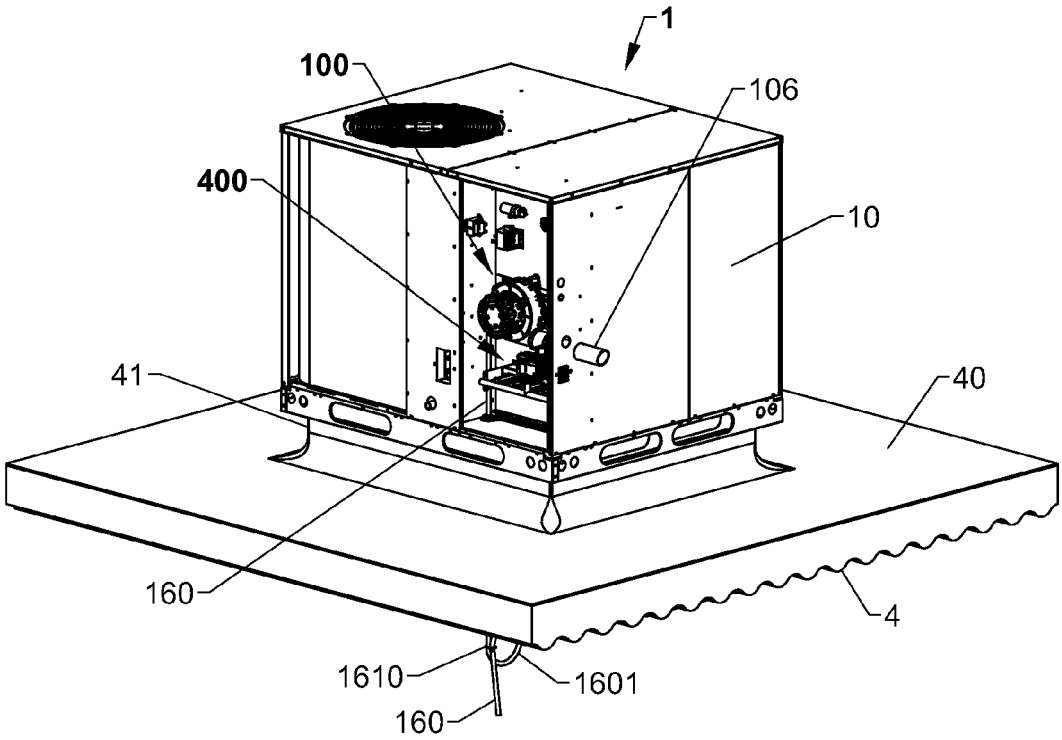
FIG. 1 is an isometric top right front view of an example of an air conditioning unit packaged with a condensing gas heat exchanger for efficiently heating and cooling a space that is installed on the roof of a building with a condensate drain line that extends from the unit through the roof outside of the supply and return ducts for disposal of the condensate, for example, within the building.

These drawings illustrate, among other things, examples of embodiments of the invention. Other embodiments may differ.

SUMMARY OF PARTICULAR EMBODIMENTS OF THE INVENTION

This invention provides, among other things, various air conditioning units with condensing gas heat exchangers (i.e., condensing gas package units) for installation outdoors that can be mounted on the roof of a building or on the ground, condensing gas package units configured to drain condensate through the return air duct or through the floor of the unit, condensing gas package units configured to drain condensate through the inducer fan, collectors for condensing heat exchangers for HVAC units, apparatuses that pass a tube (e.g., a condensate drain line) through the wall of a duct and form a trap in the tube, and methods of reducing fuel consumption from widely used HVAC equipment by manufacturing, obtaining, or providing condensing gas package units and advertising that they can be installed, for example, on a roof or on the ground. Various examples include air conditioning units or HVAC units with condensing (e.g., gas) heat exchangers, and devices, systems, methods related to such air conditioning units or HVAC units.

Various embodiments provide, for example, as an object or benefit, that they partially or fully address or satisfy one or more needs, potential areas for benefit, or opportunities for improvement described herein, or known in the art, as examples. Certain embodiments provide, for example, equipment, apparatuses, units, and methods that allow condensing furnaces to be installed and used outdoors. In particular, various embodiments prevent, avoid, or reduce problems that result from the freezing of condensate from condensing furnaces that are installed outdoors. A number of embodiments prevent, or help to prevent, frozen condensate from interfering with continued operation of the HVAC unit, from collecting, from causing a hazard or nuisance, or a combination thereof, as examples. Certain embodiments provide, as objects or benefits, for instance, condensing furnaces, means and methods of disposing of condensate from condensing furnaces, and devices that make such equipment and systems possible or practical. Further, particular embodiments have as an object or benefit, for example, that they are sufficiently reliable, inexpensive, and easy to install and service to be practical for mass production, for instance, for residential applications. Moreover, some embodiments have as objects or benefits that they provide equipment or methods of manufacturing condensing gas package units, HVAC equipment and HVAC units having condensing furnaces, and systems and buildings having such devices.

Specific embodiments of the invention include various air conditioning units, each packaged with a condensing gas heat exchanger. In various embodiments, each unit includes, for example, a return duct opening for connecting the unit to a return duct that delivers air to the unit from the space, and a supply duct opening for connecting the unit to a supply duct that delivers air from the unit to the space. In addition, a number of such embodiments further include the condensing gas heat exchanger for heating the air, a collector connected to the condensing gas heat exchanger, and an inducer fan having an inlet connected to the collector. Moreover, such embodiments may further include a drain line opening penetrating the collector, and a condensate drain line connected to the drain line opening. In a number of embodiments, the condensate drain line extends to the return duct opening, for example, for routing through the return duct for disposal of the condensate.

In some embodiments, there is, for example, a tubular conduit through which the condensate drain line passes between the drain line opening penetrating the collector and the return duct opening. Further, some embodiments further include, for instance, a heating section containing the condensing gas heat exchanger. In a number of embodiments, the condensate drain line passes through the heating section and the tubular conduit protects the condensate drain line from direct heat from the condensing gas heat exchanger where the condensate drain line passes through the heating section. Still further, some embodiments include an outdoor section. In a number of embodiments, the condensate drain line passes through the outdoor section and the tubular conduit protects the condensate drain line from freezing where the condensate drain line passes through the outdoor section.

Even further, some embodiments include, for example, an interstitial space between the condensate drain line and the tubular conduit. Particular embodiments still further include, for example, an inlet passageway from the heating section to the interstitial space, an outlet passageway from the interstitial space to the return section, or both. Moreover, in a number of embodiments, air is allowed to flow from the heating section, through the inlet passageway, through the interstitial space along the condensate drain line, and out the outlet passageway to the return section. This flow of air may keep the condensate drain line from freezing where the condensate drain line passes through the outdoor section. Moreover, in a number of embodiments, the condensate drain line attaches to the drain line opening penetrating the collector in the outdoor section. Further, in some embodiments, after the condensate drain line attaches to the drain line opening penetrating the collector, the condensate drain line passes into the heating section. Even further, in some embodiments, the condensate drain line passes through the heating section, then through the outdoor section, and then into the return section.

Other specific embodiments of the invention include various air conditioning units that are packaged with a condensing gas heat exchanger that include, for example, in addition to the condensing gas heat exchanger for heating the air, a collector connected to the condensing gas heat exchanger and a tubular conduit for passing a condensate drain line. In a number of embodiments, the tubular conduit extends from proximate a drain line opening penetrating the collector to the return duct opening for routing the condensate drain line from the drain line opening penetrating the collector to the return duct opening and through the return duct for disposal of the condensate. Such embodiments may also include a return duct opening for connecting the unit to a return duct that delivers air to the unit from the space, a supply duct opening for connecting the unit to a supply duct that delivers air from the unit to the space, and an inducer fan that may have an inlet connected to the collector, for instance.

Particular such embodiments further include, for example, a heating section containing the condensing gas heat exchanger, the tubular conduit may pass through the heating section and protect the condensate drain line therein from direct heat from the condensing gas heat exchanger. Moreover, some embodiments further include, for example, an outdoor section and the tubular conduit may pass through the outdoor section and protect the condensate drain line therein from freezing where the tubular conduit passes through the outdoor section. Certain embodiments have an interstitial space inside the tubular conduit and an inlet passageway from the heating section to the interstitial space, an outlet passageway from the interstitial space to the return section, or both. Moreover, in a number of embodiments, when the unit is operating, air flows from the heating section, through the inlet passageway, through the interstitial space along the condensate drain line therein, and out the outlet passageway to the return section. This may keep the condensate drain line from freezing where the condensate drain line passes through the outdoor section, for example. Further, in a number of embodiments, the drain line opening penetrating the collector is in the outdoor section and the tubular conduit extends from the outdoor section to the return duct opening. Even further, in particular embodiments, the tubular conduit passes through the heating section, then through the outdoor section, and then to the return section.

Still other specific embodiments of the invention include air conditioning units packaged with condensing gas heat exchangers that include, for example, a drain line hole in the floor of the enclosure for the unit for passing a drain line. Such embodiments may include, for example, within a single enclosure, a return duct opening for connecting the unit to a return duct that delivers air to the unit from the space, a supply duct opening for connecting the unit to a supply duct that delivers air from the unit to the space, and the condensing gas heat exchanger for heating the air. Further, such embodiments may also include within the enclosure, a collector connected to the condensing gas heat exchanger, an inducer fan having an inlet connected to the collector, and a drain line opening penetrating the collector for attaching the drain line. In various embodiments, the drain line hole is located substantially below the drain line opening for passage of a drain line from the drain line opening, through the drain line hole, for disposal of the condensate.

Some embodiments may further include a roof curb assembly for supporting the unit on a roof of a building and containing the return duct and the supply duct. The roof curb assembly may include, for example, a tubular conduit for passage of the condensate drain line for disposal of the condensate within the building. In a number of embodiments, when the unit is installed on the roof, the tubular conduit extends from the floor of the enclosure of the unit, through the roof curb assembly, and through the roof of the building. In particular embodiments, when the unit is installed on the roof, the tubular conduit is substantially vertical at the floor of the enclosure of the unit and the drain line hole in the floor is directly below the drain line opening in the collector. Furthermore, in a number of embodiments, when the unit is installed on the roof, the tubular conduit is substantially vertical from the floor of the enclosure of the unit through the roof of the building. On the other hand, in some embodiments, the tubular conduit extends from the drain line hole in the floor, at a slope through the roof curb assembly, to the return duct and the supply duct, and through the roof of the building between the return duct and the supply duct.

Moreover, in some embodiments, the unit further has (e.g., at least one of) a condensate drain line connected to the drain line opening or a tubular conduit for passing a condensate drain line. The condensate drain line may extend to the return duct opening or the tubular conduit may extend from proximate the drain line opening penetrating the collector to the return duct opening. Such a configuration may be, for example, for routing the drain line through the return duct for disposal of the condensate.

In addition, various other embodiments of the invention are also described herein, and other benefits of certain embodiments may be apparent to a person of ordinary skill in the art.

DETAILED DESCRIPTION OF EXAMPLES OF EMBODIMENTS

The subject matter described herein includes, as examples, various condensing gas package units configured for installation outdoors. As used herein, a gas package unit is an air conditioning unit that is packaged with a gas furnace. A number of embodiments include, for example, with in the same enclosure, both a packaged air conditioning unit and a condensing gas heat exchanger. U.S. patent application Ser. No. 12/271,471, Publication 2010/0122806 (Halgash), illustrates an example of a heat exchanger that may be a condensing gas heat exchanger. Condensing heat exchangers extract more heat from the products of combustion, which makes them more efficient than non-condensing heat exchangers. As a result, air conditioning units packaged with condensing heat exchangers are typically more efficient in a heating mode than air conditioning units packaged with non-condensing heat exchangers. In the process of heat extraction, however, condensation from the products of combustion forms in condensing heat exchangers, and this condensation must be disposed of. Further, when ambient conditions are below freezing, the condensation must be disposed of without creating problems associated with freezing of the condensation.

Some embodiments of gas package units described herein can be mounted either on the roof of a building or on the ground (e.g., on a ground level slab). Certain embodiments are suitable for installation in both locations. Further, some of the condensing gas package units described herein are configured to drain condensate (e.g., liquid water condensed from the products of combustion) through a drain line that passes through the return air duct or through the floor of the unit. Such units may be installed on the roof of a building, for example. Other condensing gas package units described herein are configured to drain condensate through the inducer fan. Condensing gas package units described herein that are configured to drain condensate through the inducer fan may be used for installation on the ground or on a ground-level slab, for example.

Also described are particular collectors for condensing heat exchangers (e.g., for HVAC units such as gas package units), and apparatuses that pass a tube (e.g., a condensate drain line) through the wall of a duct and form a trap in the tube. Also described are various methods, for instance, of reducing fuel consumption from widely used HVAC equipment by manufacturing, obtaining, or providing condensing gas package units and advertising that they can be installed on a roof or on the ground. Described are various examples of air conditioning units and HVAC units with condensing (e.g., gas) heat exchangers, and devices, systems, methods related to such air conditioning units and HVAC units. Moreover, other embodiments include various buildings containing such devices, companies performing one or more of the methods described herein, computer-readable storage media, computers programmed to perform a method described herein, and computer software, as examples. Methods described herein include methods of improving HVAC units, methods of replacing HVAC equipment (e.g., which may provide better performance, efficiency, or both); methods of configuring HVAC units (e.g., air conditioning units), methods of providing HVAC equipment described herein, and methods of adapting and distributing HVAC equipment (e.g., gas package units), for instance.

As used herein, the term "HVAC unit" includes air conditioning units, heat pumps, and air conditioning units packaged with furnaces, including condensing furnaces. Further, "gas" furnaces and heat exchangers are mentioned and described herein. The "gas" may be natural gas or propane, as examples. Other condensing furnaces or heat exchangers, however, may burn, or may be configured to burn, other fossil fuels such as fuel oil, heating oil, gasoline, kerosene, diesel fuel, or coal, as examples. Further, some embodiments may burn a renewable fuel such as a bio fuel, wood, methane, or hydrogen, as other examples. Many aspects of equipment configured for such fuels may be the same or similar to equipment configured to burn natural gas or propane.

Furthermore, as used herein, if a device is said to be "configured" to perform a certain task or function, the term "configured" means that the device has been adapted specifically to perform that particular task or function, not merely that the device could be used for that particular task or function if doing so had been contemplated. For example, as used herein, a controller is "configured" to perform a particular task or function if the controller has been programmed with instructions that will, if executed, perform that specific task or function. A controller simply being made to control similar equipment and being capable of being programmed to perform the particular task or function is not enough, absent the software instructions to do so or other specific adaptation to accomplish the particular task or function recited.

Figure 7:
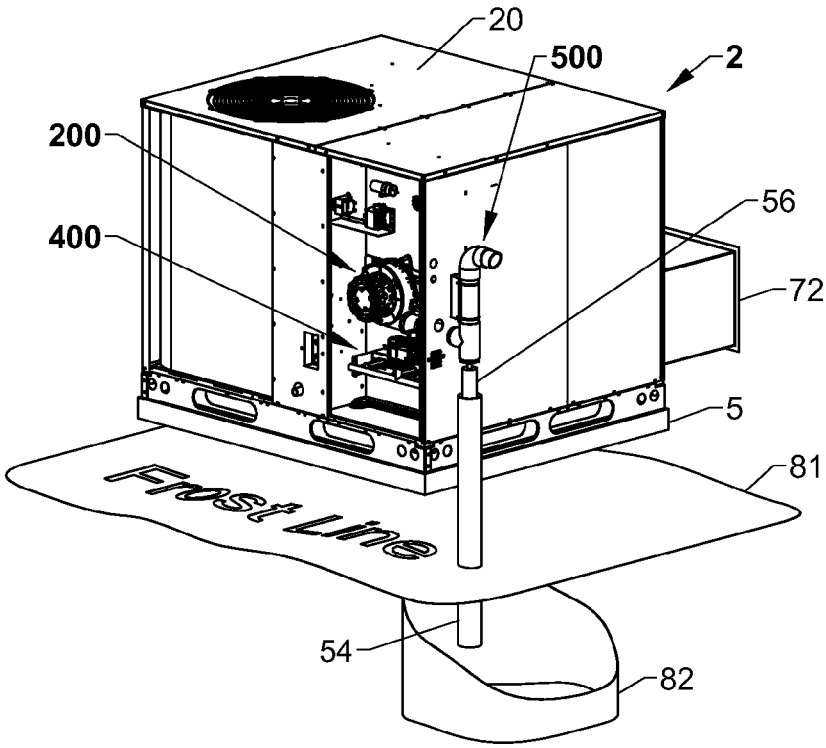
FIG. 7 is an isometric top right front view of an example of an air conditioning unit packaged with a condensing gas heat exchanger for efficiently heating and cooling a space that is installed on a ground-level slab and that allows condensate to travel through the inducer fan and exit the enclosure of the unit with the combustion gasses, and that includes a bifurcation in the exhaust conduit from the inducer fan to separate the condensate from a portion of the combustion gasses for disposal of the condensate into the ground.
Figure 8:
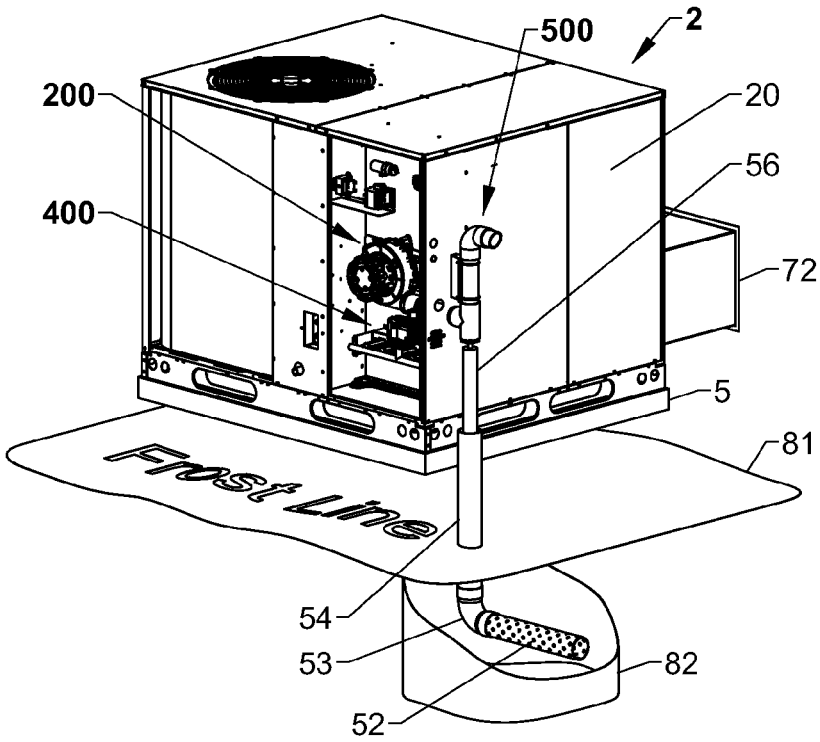
FIG. 8 is an isometric top right front view of the example of an air conditioning unit of FIG. 7 wherein the condensate is disposed of into a standpipe connected to a horizontal section of pipe with multiple holes into the ground below the frost line.
Figure 9:
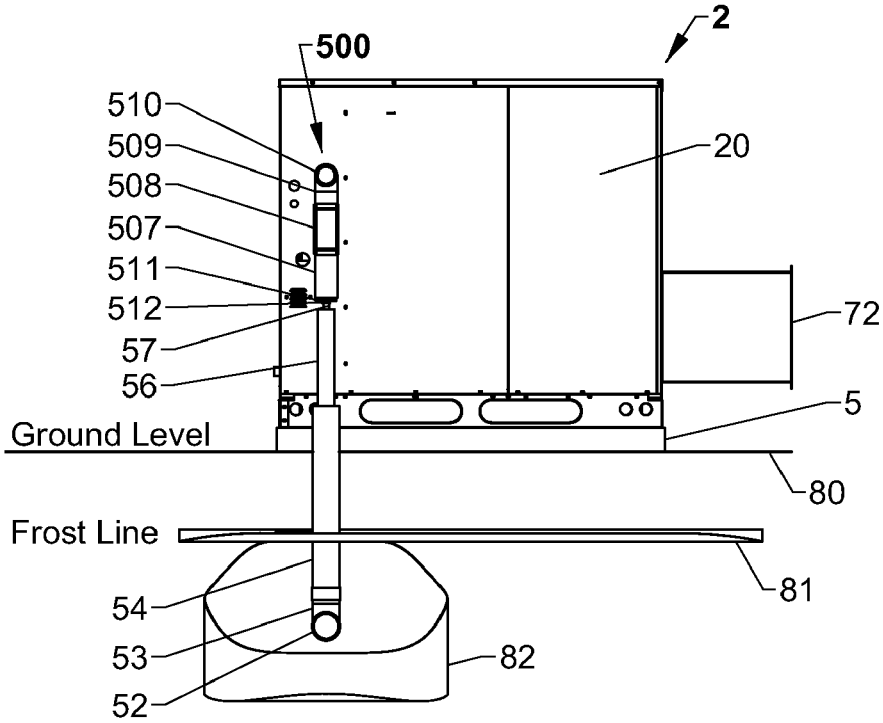
FIG. 9 is a right side view of the example of an air conditioning unit of FIG. 8.
Figure 10:
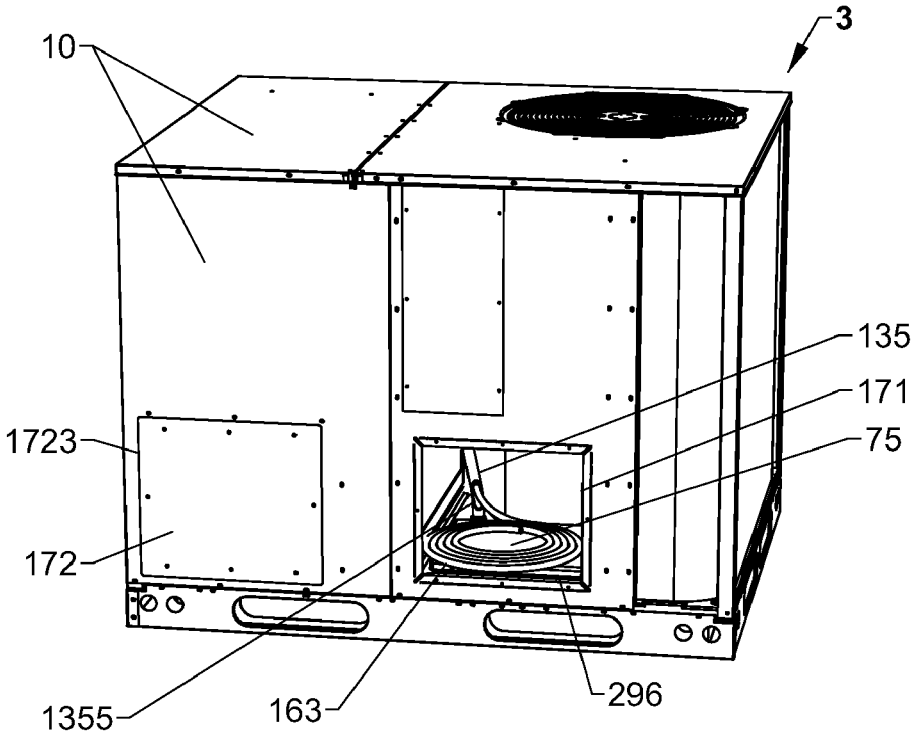
FIG. 10 is an isometric top left rear view of an example of an air conditioning unit packaged with a condensing gas heat exchanger for efficiently heating and cooling a space that is configured for shipping with a conduit and drain line extending to the return duct opening for routing of the drain line through the return duct during installation of the unit for disposal of the condensate (e.g., within the building)
Figure 15:
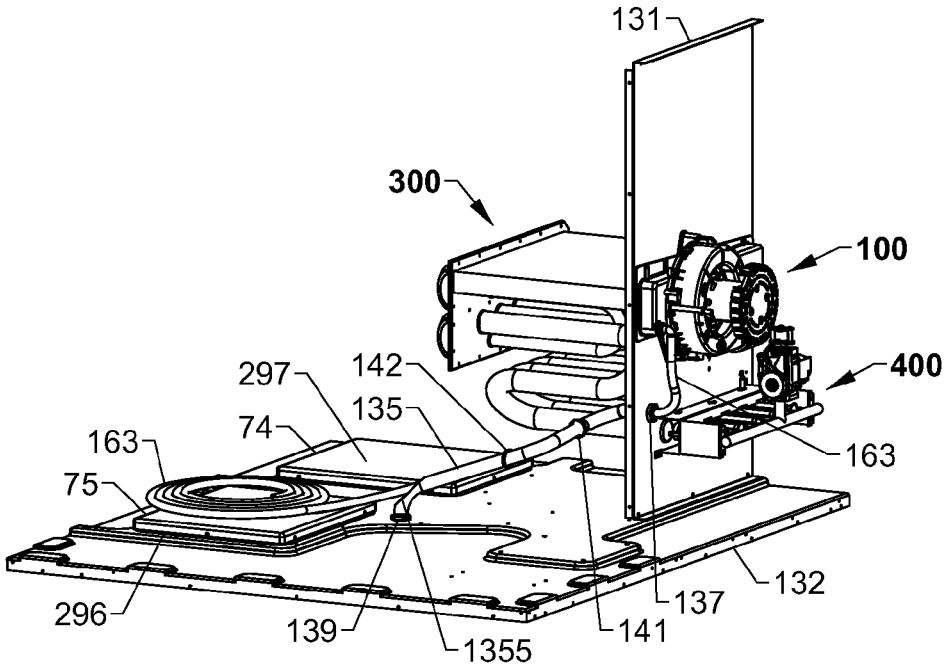
FIG. 15 is an isometric top left front view of the example of an air conditioning unit of FIG. 10 that is configured for shipping and that is drawn with many of the components omitted to better illustrate the remaining components, and illustrating the condensing gas heat exchanger, condensate collector assembly including the inducer fan, burner assembly or gas manifold assembly, conduit, and drain line extending to the return duct opening for routing through the return duct during installation of the unit for disposal of the condensate, for example, within the building.

The figures illustrate several specific embodiments of air conditioning units, each packaged with a condensing gas heat exchanger, for example, for efficiently heating and cooling a space. In a number of embodiments, the units are configured for installation at ground level and the units are also configured for installation on a roof of a building. Other embodiments, however, may be configured just for installation at ground level or just for installation on a roof of a building. FIGS. 1-6, 11-13, 15-19, and 28-31 show air conditioning unit 1, packaged with condensing gas heat exchanger 300 (shown in detail in FIG. 26). In FIGS. 1-6, air conditioning unit 1 is shown mounted or roof 4 of a building. Just a section of roof 4 is shown. Roof 4 includes roof covering 40 and roof curb flashing 41 in the embodiments shown in FIGS. 1 and 6, for example. FIG. 10 shows air conditioning unit 3, which may be the same as air conditioning unit 1, except in a shipping configuration. Further, FIG. 15 shows part of air conditioning unit 3 in the shipping configuration. In contrast, FIGS. 7-9 show air conditioning unit 2 which is shown installed on ground level (e.g., 80 shown in FIG. 9) concrete slab 5. Air conditioning units 1, 2, and 3 may be the same or similar, except as described herein, and, in some embodiments, may be both configured for installation at ground level (e.g., 80 or on slab 5) and also configured for installation on a roof (e.g., 4) of a building. In addition, air conditioning units 1, 2, and 3 are examples of HVAC units that have condensing gas heat exchangers and collectors, as described herein.

Figure 29:
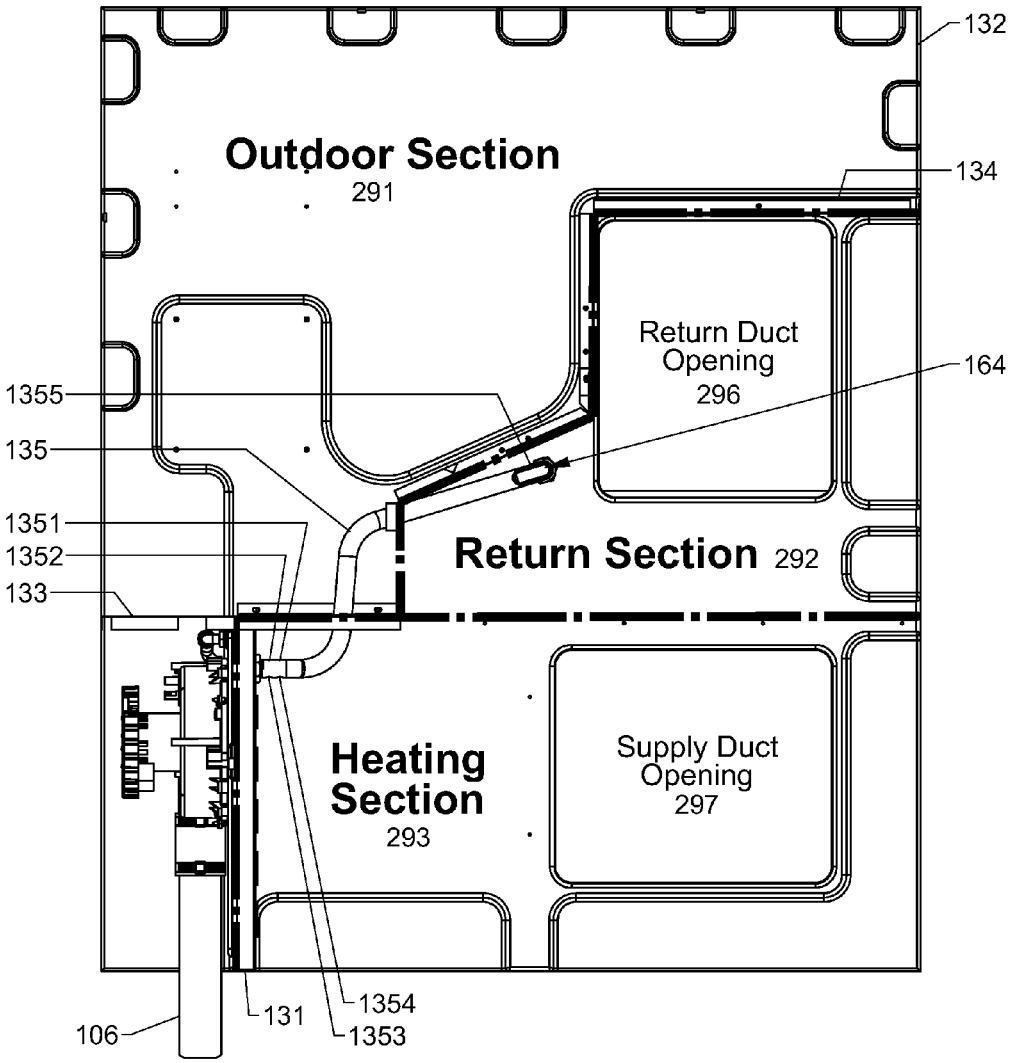
FIG. 29 is a top view of the example of an air conditioning unit of FIGS. 16, 18, 19, and 28 that is drawn with many of the components omitted to better illustrate the remaining components, and illustrating, among other things, the outdoor section, return section, and heating section of the unit, and the drain line conduit extending from the outdoor section proximate the drain line opening in the collector to the return section.

In the embodiments illustrated, air conditioning units 1 and 3 each include single outer enclosure 10, and air conditioning unit 2 includes single outer enclosure 20. In some embodiments, enclosures 10 and 20 may be similar or identical. As shown in FIG. 29, each unit 1 includes, for example, within single enclosure 10, outdoor section 291, return section 292, and heating section 293. When unit 1 is in operation, outdoor section 291 contains outdoor air and is normally at the ambient temperature except for temperature differences resulting from heat transfer from the other sections. Return section 292, on the other hand, contains return air from the building and is normally at the temperature within the building, potentially differing therefrom only slightly as a result of any heat transfer in the ductwork or unit. Further, heating section 293 contains heat exchanger 300, which, when in operation, heats the air in return section 293 substantially above that of return section 292. An indoor air fan or blower (not shown) blows air from return section 292 into heating section 293. As a result, the static pressure within heating section 293 is normally higher than the static pressure within return section 292 when unit 1 is in operation (when the indoor air fan or blower is operating).

Unit 1 also includes supply duct opening 297 for connecting the unit to a supply duct that delivers air from the unit (e.g., from heating section 293) to the space (e.g., within the building). As used herein, unless stated or apparent otherwise, if two components are said to be "connected" (and variations thereof such as "connecting") those components may be directly connected or may be indirectly connected via one or more other components (e.g., other than those parts shown or described herein) that may perform no other significant function beyond the connection described. For example, a duct is said to be "connected" to a unit even if there is an extension or flexible coupling between the duct and the unit. Similarly, a drain line is said to be connected to a collector or to an opening therein even if there is a fitting (e.g., 102) between the drain line and the collector.

Figure 16:
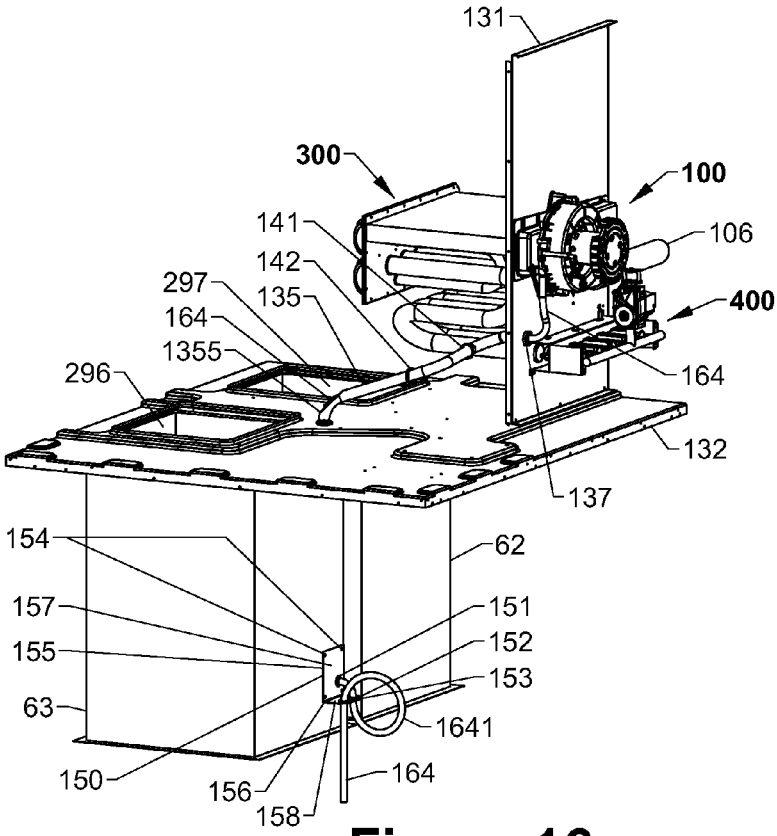
FIG. 16 is an isometric top left front view of the example of an air conditioning unit of FIGS. 10 and 15 that is connected to vertical ducts, for example, on the roof of a building, and that is drawn with many of the components omitted to better illustrate the remaining components, and illustrating the condensing gas heat exchanger, condensate collector assembly including the inducer fan, burner assembly or gas manifold assembly, conduit extending to the return duct opening, and drain line extending through the conduit and the vertical return duct, for instance, into the building, and then penetrating the wall of the return duct to form a trap and continuing downward for disposal of the condensate, for instance, within the building.
Figure 18:
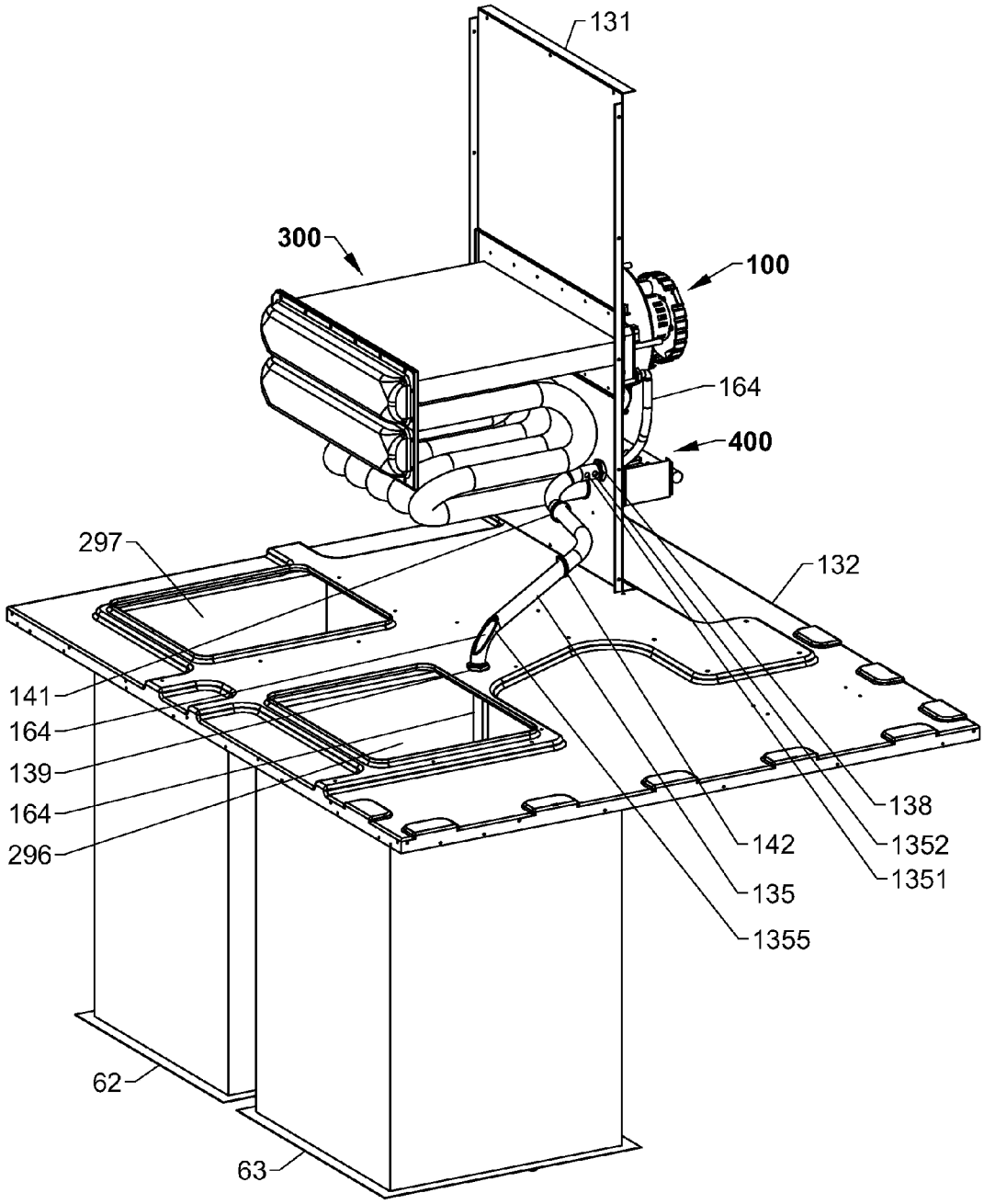
FIG. 18 is an isometric top left rear view of the example of an air conditioning unit of FIGS. 10, 15, and 16 that is connected to vertical ducts, for example, on the roof of a building, and that is drawn with many of the components omitted to better illustrate the remaining components, and illustrating, among other things, the conduit extending from proximate the drain line opening penetrating the collector to the return duct opening and the drain line extending through the conduit and through the return duct, for example, into the building for disposal of the condensate (e.g., within the building)
Figure 19:
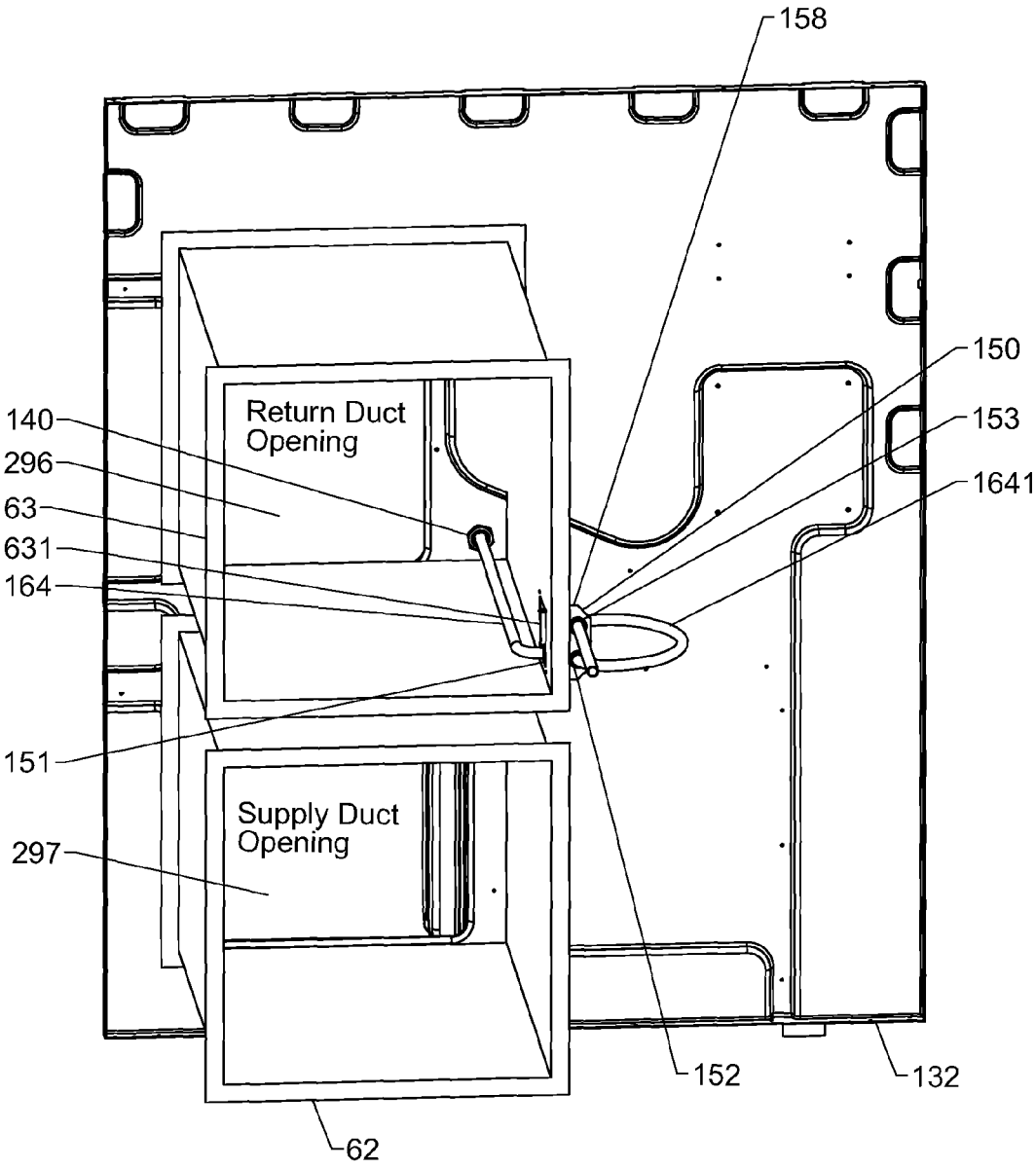
FIG. 19 is an isometric bottom left rear view of the example of an air conditioning unit of FIGS. 16 and 18 that is connected to vertical ducts, for example, on the roof of a building, and illustrating, among other things, the drain line extending from the conduit through the return duct, and showing the trap, for instance, within the building.
Figure 20:
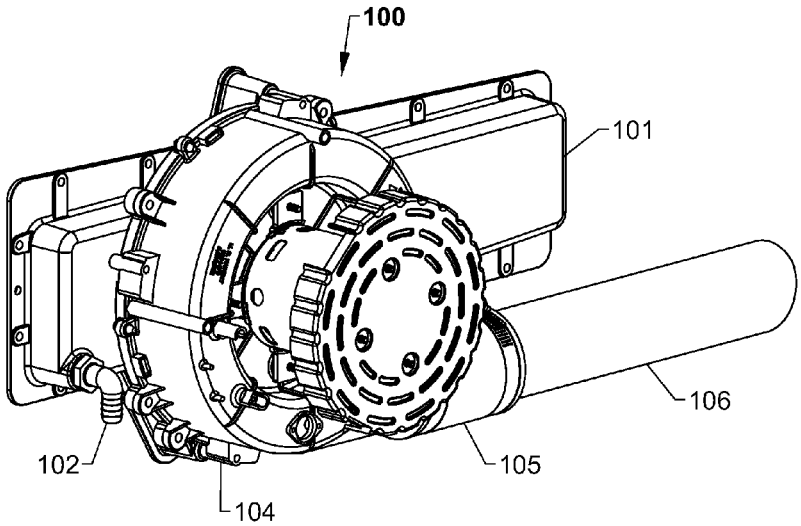
FIG. 20 is an isometric top left front view of the condensate collector assembly that may be part of the air conditioning unit of any of FIGS. 1-4, 6, 7-8, and 11-18, illustrating, among other things, the inducer fan, collector, drain line opening, and fitting or elbow for connecting to the drain line, for example, for disposal of the condensate within the building.

In the embodiment illustrated, supply duct opening 297 is in heating section 293. In addition, in the embodiment shown, return section 292 contains return duct opening 296 for connecting the unit to a return duct that delivers air to the unit from the space (e.g., within the building). FIGS. 2-5 show (e.g., a section of) vertical return duct 61 and FIGS. 2-6 show (e.g., a section of) vertical supply duct 62, which are connected to return duct opening 296 and supply duct opening 297 respectively. In addition, FIGS. 16, 18, 19, and 28 show (e.g., a section of) vertical return duct 63 and FIGS. 16, 18, and 19 show (e.g., a section of) vertical supply duct 62, which, in other embodiments, are connected to return duct opening 296 and supply duct opening 297 respectively. Omitted in FIG. 29, but shown in FIGS. 11-18, heating section 293 also contains condensing (e.g., gas) heat exchanger 300.

Figure 12:
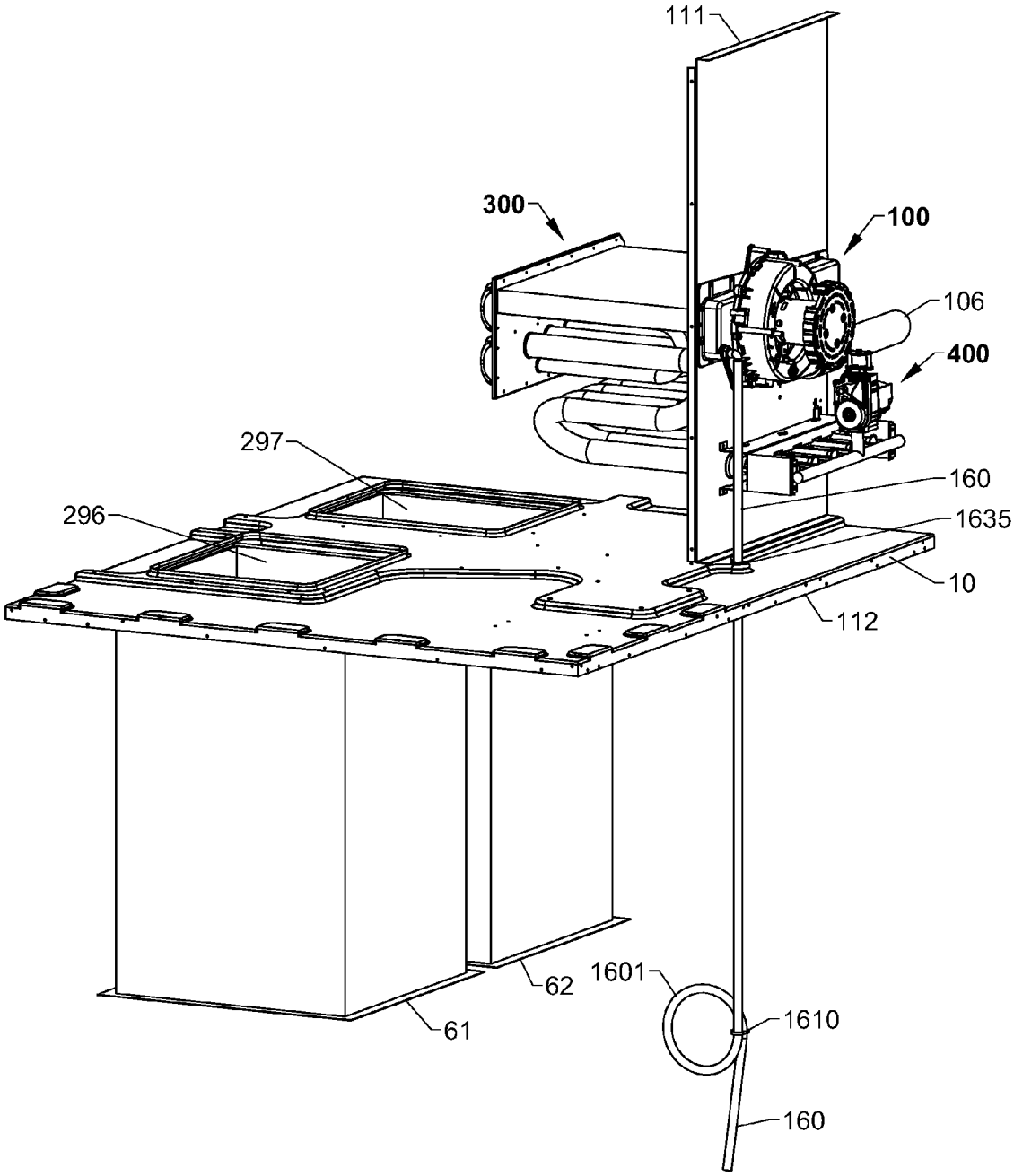
FIG. 12 is an isometric top left front view of the example of an air conditioning unit of FIGS. 1 and 3 drawn with many of the components omitted to better illustrate the remaining components, and illustrating the condensing gas heat exchanger, condensate collector assembly including the inducer fan, burner assembly or gas manifold assembly, and condensate drain line that extends from the collector assembly vertically downward through the floor of the unit without using a conduit or insulation, and on vertically downward, for instance, through the roof of the building, and that forms a loop or trap, for instance, within the building.
Figure 13:
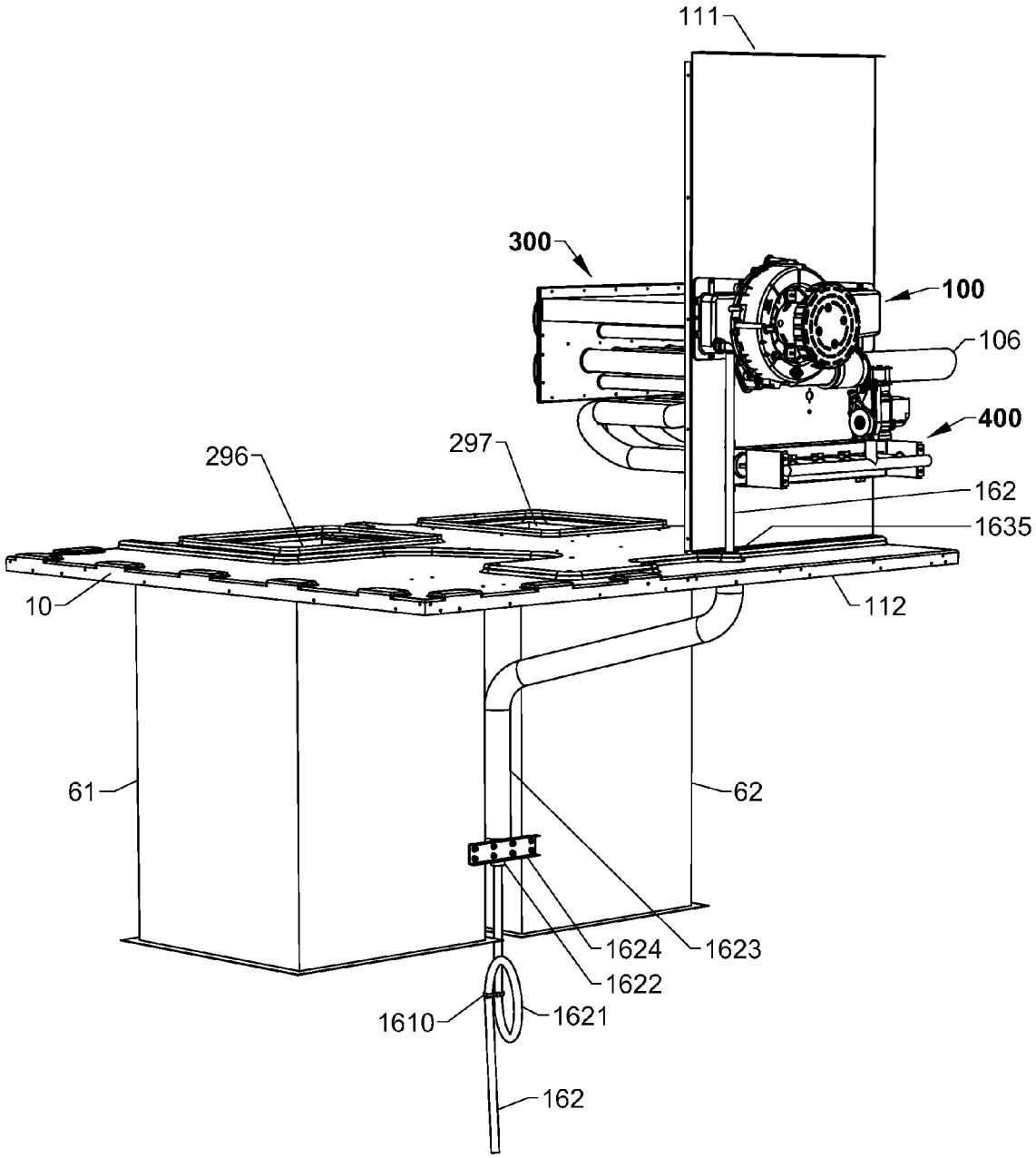
FIG. 13 is an isometric top left front view of the example of an air conditioning unit of FIGS. 4-6*a* drawn with many of the components omitted to better illustrate the remaining components, and illustrating the condensing gas heat exchanger, condensate collector assembly including the inducer fan, burner assembly or gas manifold assembly, and condensate drain line that extends from the collector assembly vertically downward through the floor of the unit, and through the insulated conduit which extends at a slope to the return and supply ducts and through the roof between the ducts.
Figure 14:
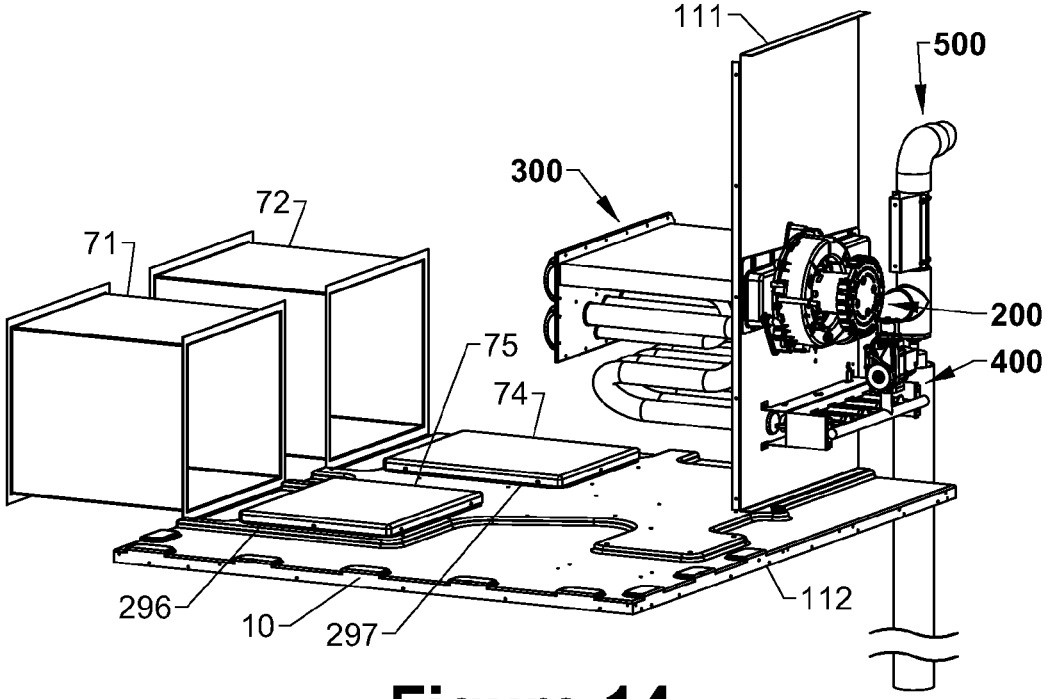
FIG. 14 is an isometric top left front view of the example of an air conditioning unit of FIGS. 7-9 drawn with many of the components omitted to better illustrate the remaining components, and illustrating the condensing gas heat exchanger, condensate collector assembly including the inducer fan, burner assembly or gas manifold assembly, and exhaust conduit or exhaust and drainage assembly for disposal of the condensate into the ground, and further illustrating horizontal return and supply ducts which may be used when the unit is installed at ground level.
Figure 17:
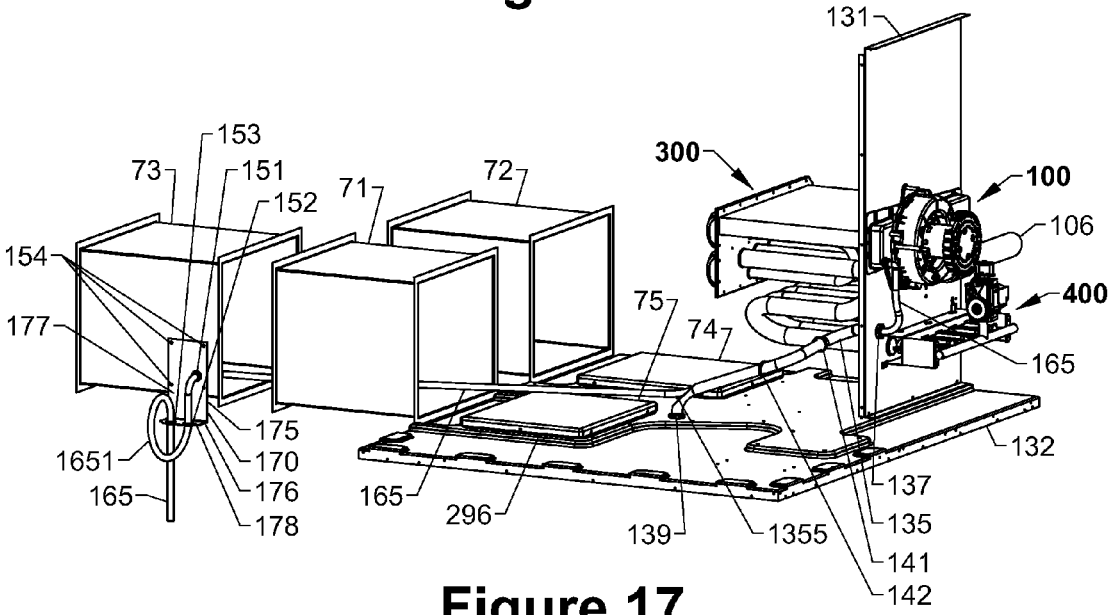
FIG. 17 is an isometric top left front view of the example of an air conditioning unit of FIGS. 10 and 15 that is connected to horizontal ducts, for example, when the unit is installed at ground level, that is drawn with many of the components omitted to better illustrate the remaining components, and illustrating the condensing gas heat exchanger, condensate collector assembly including the inducer fan, burner assembly or gas manifold assembly, conduit extending to the return duct opening, and drain line extending through the horizontal return duct, for instance, into the building, and then penetrating the wall of the return duct to form a trap and for disposal of the condensate, for example, within the building.

As illustrated in FIGS. 7-9, 14, and 17, in some embodiments, and in some applications, air conditioning units or gas package units (e.g., 1 or 2, for instance, packaged with a condensing heat exchanger 300, for example) may be connected to horizontal ducts (e.g., return duct 71 and supply duct 72 shown in FIGS. 14 and 17) rather than to vertical ducts (e.g., 61 and 62 or 62 and 63 shown in FIGS. 2-6, 11-13, 16, 19, and 28). As shown in FIGS. 10, 14, and 17, in particular embodiments, the air conditioning units are fitted with return duct opening 296 and supply duct opening 297 for vertical ducts (e.g., 61 and 62 or 62 and 63) and also with return duct opening 171 and supply duct opening 172 for horizontal ducts (e.g., 71 and 72). When not connected to a vertical duct, return duct opening 296 and supply duct opening 297 for vertical ducts may be covered with opening covers 75 and 74, respectively, (e.g., as shown in FIGS. 14, 15, and 17). Similarly, when not connected to a horizontal duct, return duct opening 171 and supply duct opening 172 for horizontal ducts may be covered with opening covers such as opening cover 1723 show in FIG. 10 covering supply duct opening 172. Opening covers may be sheet metal, for example, and may be secured with fasteners such as sheet metal screws, for instance.

Figure 27:
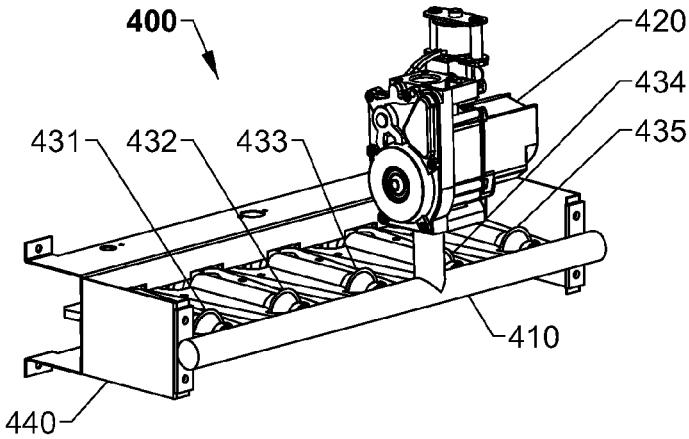
FIG. 27 is an isometric top left front view of the gas manifold assembly of the air conditioning unit packaged with a condensing gas heat exchanger of FIGS. 1-4, 6-8, and 11-18 illustrating, among other things, the multiple burners of the embodiment shown.
Figure 28:
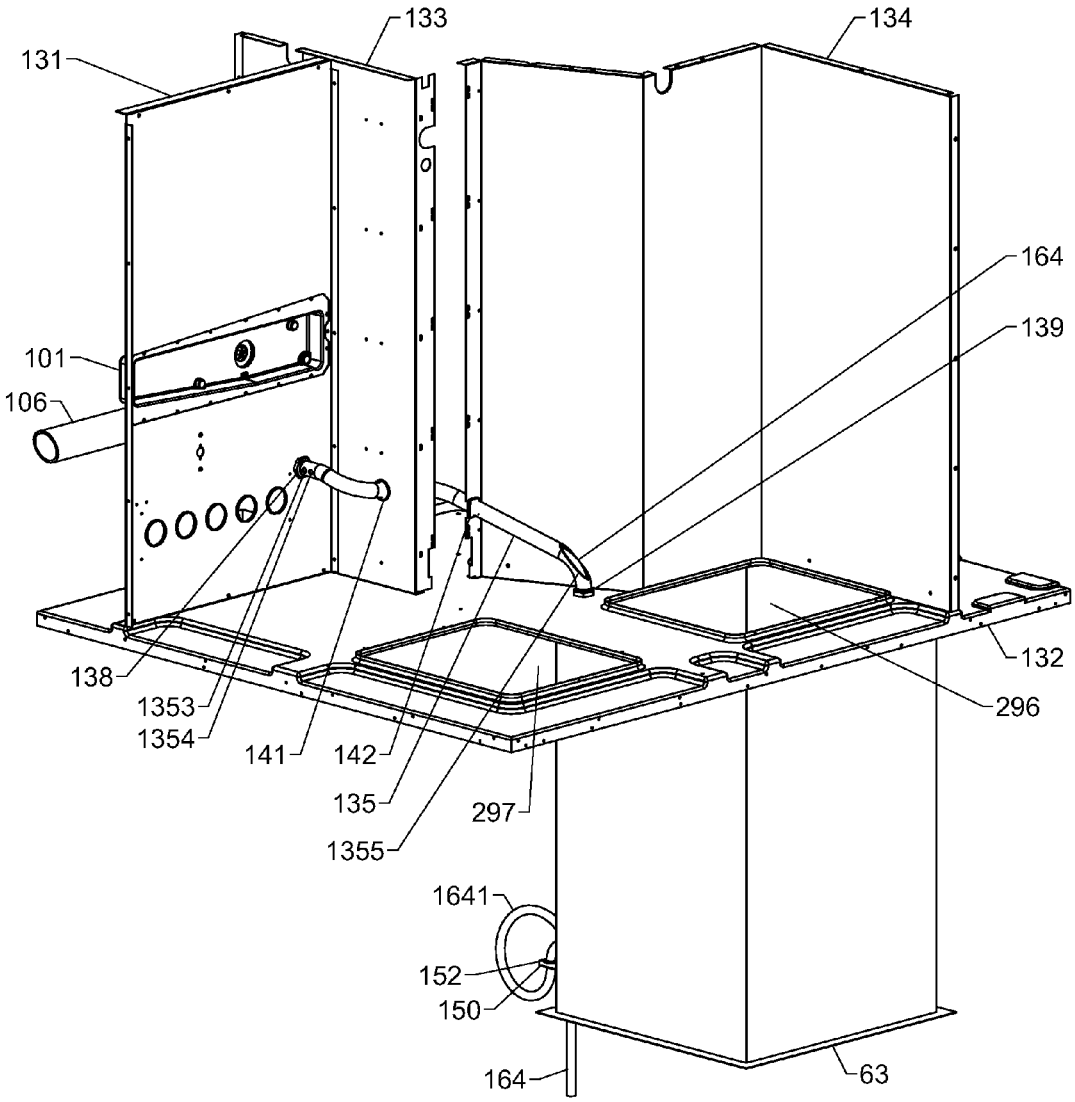
FIG. 28 is an isometric top right rear view of the example of an air conditioning unit of FIGS. 16, 18, and 19 that is connected to vertical ducts, for example, on the roof of a building, and that is drawn with many of the components omitted to better illustrate the remaining components, and illustrating, among other things, the conduit extending from the outdoor section proximate the drain line opening in the collector to the return section, the drain line extending to and through the return duct, several partitions within the unit, and the trap, for instance, within the building.

In the embodiment illustrated, outdoor section 291 further includes burners 431, 432, 433, 434, and 435, of burner assembly or gas manifold assembly 400 shown in FIGS. 6 and 11-18, and in detail in FIG. 27. In the embodiment shown, burners 431, 432, 433, 434, and 435, of gas manifold assembly 400 fire into condensing gas heat exchanger 300. Although five burners are shown, various embodiments include one or more burners firing into the condensing gas heat exchanger. As used herein, "one or more" means at least one. Different embodiments may have 1, 2, 3, 4, 5, 6, 7, 8, 9, 10, 11, 12, 13, 14, or 15 burners firing into the condensing gas heat exchanger, as examples. As illustrated in FIG. 27, in the embodiment illustrated, burner assembly or gas manifold assembly 400 further includes gas valve 420, gas manifold pipe 410, and gas manifold pipe bracket 440.

In the embodiment depicted, outdoor section 291 further includes collector pan or collector 101 connected to condensing gas heat exchanger 300, and inducer fan 104 having inlet 1016 connected to collector 101 labeled by reference number in FIGS. 20-24. In addition, collector 101 and inducer fan 104 are part of collector assembly 100 (e.g., configured for internal drainage) and 200 (e.g., configured for external drainage through inducer fan 104) shown in FIGS. 1-4, 6, 7-8, 11-18, and 20-23. In a number of embodiments, inducer fan 104, when operating, draws air past the one or more burners (i.e., burners 431, 432, 433, 434, and 435, of gas manifold assembly 400, in the embodiment shown) and draws combustion gasses through the condensing gas heat exchanger (e.g., 300) and collector (e.g., 101) and exhausts the combustion gasses through an outlet (e.g., 105 shown in FIGS. 20-23) of the inducer fan (e.g., 104) to outside of the enclosure (e.g., 10 or 20). Relative to the combustion gasses, collector 101 is downstream of heat exchanger 300 and collector 101 collects the substantially cooled combustion gasses and condensate emerging from heat exchanger 300.

Figure 26:
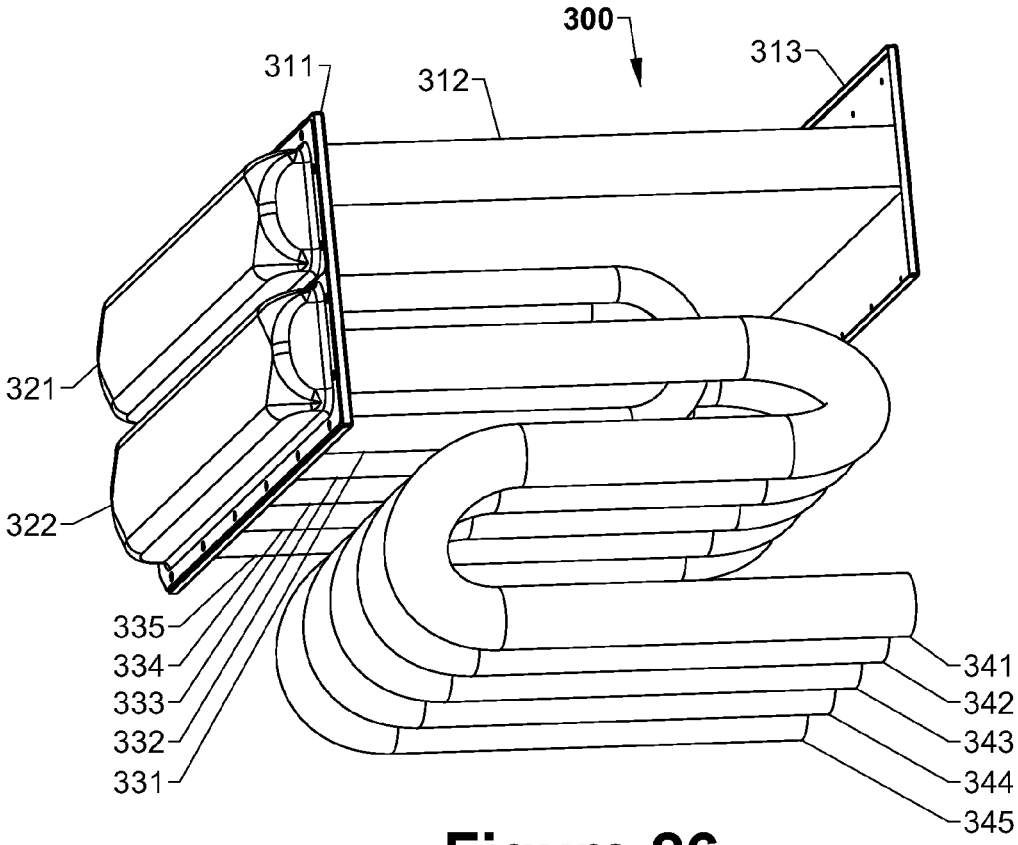
FIG. 26 is an isometric bottom left rear view of the condensing gas heat exchanger of FIGS. 11-18 illustrating, among other things, the S-tubes, U-tubes, and finned secondary heat exchanger of the embodiment shown.

Condensing heat exchanger 300 is shown in detail in FIG. 26, although other embodiments may differ. In the embodiment illustrated, heat exchanger 300 includes five primary S tubes 341, 342, 343, 344, and 345 that burners 431, 432, 433, 434, and 435 (shown in FIG. 27) fire into. At lower pan 322, products of combustion or combustion gasses from primary S tubes 341, 342, 343, 344, and 345 flow into intermediate U-tubes 331, 332, 333, 334, and 335. Further, at upper pan 321, products of combustion from intermediate U-tubes 331, 332, 333, 334, and 335 flow into finned secondary heat exchanger 312. In the embodiment illustrated, both pans 321 and 322 attach to header plate 311. Other embodiments may use separate or multiple header plates, as another example.

Further, although the embodiment of heat exchanger 300 that is illustrated includes five each of primary S tubes 341, 342, 343, 344, and 345 and intermediate U-tubes 331, 332, 333, 334, and 335, other embodiments may have one or more primary S tubes and one or more intermediate U-tubes as other examples. For instance, other embodiments may have 1, 2, 3, 4, 6, 7, 8, 9, 10, 11, 12, 13, 14, or 15 primary S tubes and 1, 2, 3, 4, 6, 7, 8, 9, 10, 11, 12, 13, 14, or 15 intermediate U-tubes as other examples.

Further, in some embodiments, the heat exchanger tubes may have a different shape. In different embodiments there may be first a U shape and then an S shape, or there may be a W shape, as examples. Further, in some embodiments, there may be multiple passes or stages that include fins. Moreover, in the embodiment illustrated, the primary S tubes 341, 342, 343, 344, and 345 are larger in diameter than intermediate U-tubes 331, 332, 333, 334, and 335. Finned secondary heat exchanger 312 may have tubes that are smaller in diameter but more numerous than the intermediate tubes (e.g., U-tubes 331, 332, 333, 334, and 335). In the embodiment illustrated, condensation of some of the products of combustion (e.g., steam or water vapor) may take place in finned secondary heat exchanger 312. Finned secondary heat exchanger 312 may terminate at header plate 313, and condensate formed therein may flow to header plate 313. As described in more detail below, in the embodiment illustrated, flange 1015 (shown, for example, in FIGS. 21 and 23) of collector 101 may attach to header plate 313 where products of combustion, including combustion gasses and condensate, may be collected. Header plate 313, finned secondary heat exchanger 312, heat exchanger 300, or a combination thereof, may be made of metal, such as aluminized steel, stainless steel, austenitic stainless steel, or superferritic (super ferritic) stainless steel, for example, AL 29-4c or UNS S44735.

Further, in the embodiment illustrated, outdoor section 291 (e.g., shown in FIG. 29) further includes, for example, drain line opening 1012 (shown, for example, in FIGS. 21-23, and in detail in FIG. 25) penetrating collector 101. In the embodiment illustrated, drain line opening 1012 is threaded and threaded fitting or elbow 102 is shown (e.g., in FIGS. 20, 22, 24, and 25) screwed into drain line opening 1012. Except where a different meaning is apparent, as used herein, the phrase "drain line opening penetrating the collector" may include a fitting, such as fitting 102, connected to the collector, if such a fitting is used in that embodiment. In the embodiment shown, outdoor section 291, and collector 101 further include drain hole 1011 (shown, for example, in FIGS. 21, 23, and 24) extending through collector 101 to the inlet (e.g., 1016) of inducer fan 104. Further still, in the embodiment illustrated, when air conditioning unit 1 or 2 is installed and leveled properly in accordance with the manufacturer's installation instructions, drain hole 1011 is higher than drain line opening 1012.

In various embodiments, the drain line opening (e.g., 1012) penetrating the collector (e.g., 101), the fitting (e.g., 102) connected thereto, or both, are in the outdoor section (e.g., 291). In other embodiments, the drain line opening (e.g., performing a function similar to drain line opening 1012) is located in the heating section (e.g., 293) and may be connected to the heat exchanger (e.g., 300). Such a configuration avoids risk of condensate freezing at the drain line opening or in the drain line within the heating section due to the heat from the heat exchanger (e.g., 300). Locating the drain line opening (e.g., 1012) penetrating the collector (e.g., 101), the fitting (e.g., 102) connected thereto, or both, in the outdoor section (e.g., 291), however, may protect the fitting (e.g., 102), drain line, or both, from direct heat from heat exchanger 300, may provide easier access to the drain line opening (e.g., 1012), the fitting (e.g., 102) connected thereto, the connection to the drain line (e.g., 160, 161, 162, 163, 164, or 165) or a combination thereof, or may provide a combination of such benefits. Further, in a number of embodiments, the outdoor section (e.g., 291), near burner assembly or gas manifold assembly 400, may not get very cold (e.g., below freezing), at least when the unit is operating, due to heat from burner assembly 300 or gas manifold assembly 400, from collector assembly 100 (including inducer fan 104 and exhaust conduit 106 or 506), through partition 111 or 131 (shown, for example, in FIGS. 11-18, 28, and 29), or a combination thereof.

In a number of embodiments, an example of which is illustrated in FIG. 29, the drain line opening (e.g., 1012) penetrating the collector (e.g., 101) is in the outdoor section (e.g., 291) and a tubular conduit (e.g., 135) extends from the outdoor section (e.g., 291) to the return duct opening (e.g., 296 or 171). As used herein, a conduit or drain line is said to extend to the return duct opening (e.g., 296 or 171) if the conduit or drain line extends into the return section (e.g., 292) and is within reach through the return duct opening (e.g., 296 or 171), for instance, before the unit is installed or connected to the ductwork. In the embodiment shown, tubular conduit 135 extends from outdoor section 291, where conduit 135 is attached to partition 131 with jam nut 137 shown in FIGS. 15, 30, and 31, through partition 131 shown in FIGS. 15-18, 28, and 29, through jam nut 138 shown in FIGS. 18, 28, 30, and 31, and into heating section 293. Further, in particular embodiments (e.g., as shown in FIG. 29), the tubular conduit (e.g., 135) passes through the heating section (e.g., 293), then through the outdoor section (e.g., 291), and then to the return section (e.g., 292). In the embodiments shown, for example, in FIGS. 15-18 and 28-31, condensate drain line 163 or 164 attaches to drain line opening 1012 penetrating collector 101 in outdoor section 291.

Figure 30:
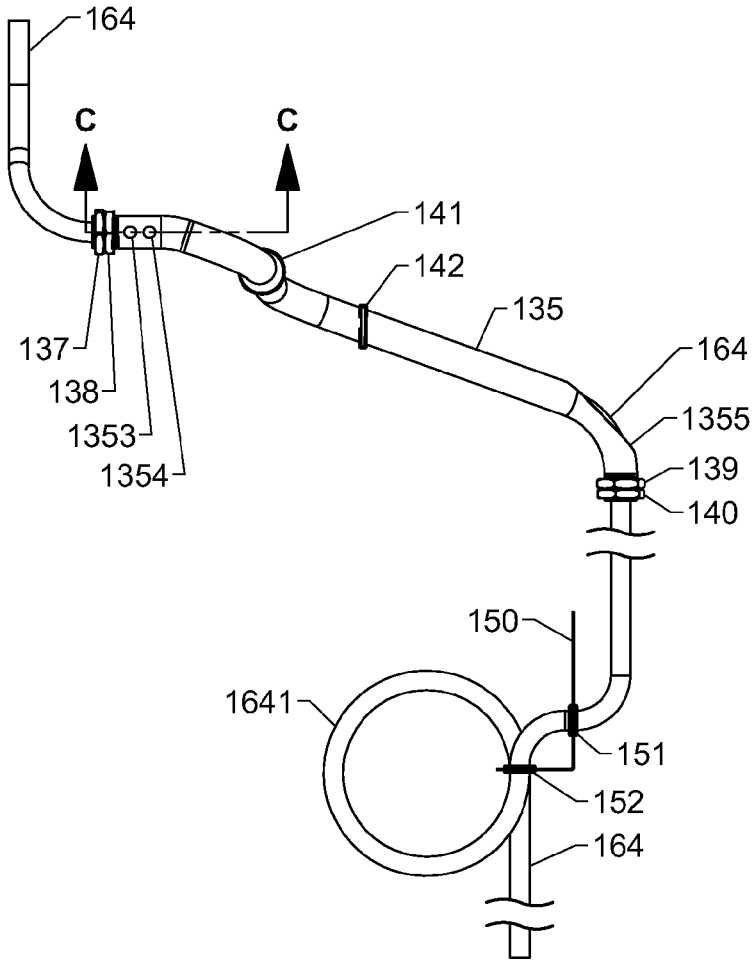
FIG. 30 is a right side view of the drain line conduit and the drain line of FIGS. 16, 18, 19, 28, and 29, illustrating, among other things, bends in the conduit and drain line, jam nuts, intake holes, an outlet passageway or cutaway opening, and an example of an apparatus for passing a tube through a wall of a duct and for forming a trap with the tube.
Figure 31:
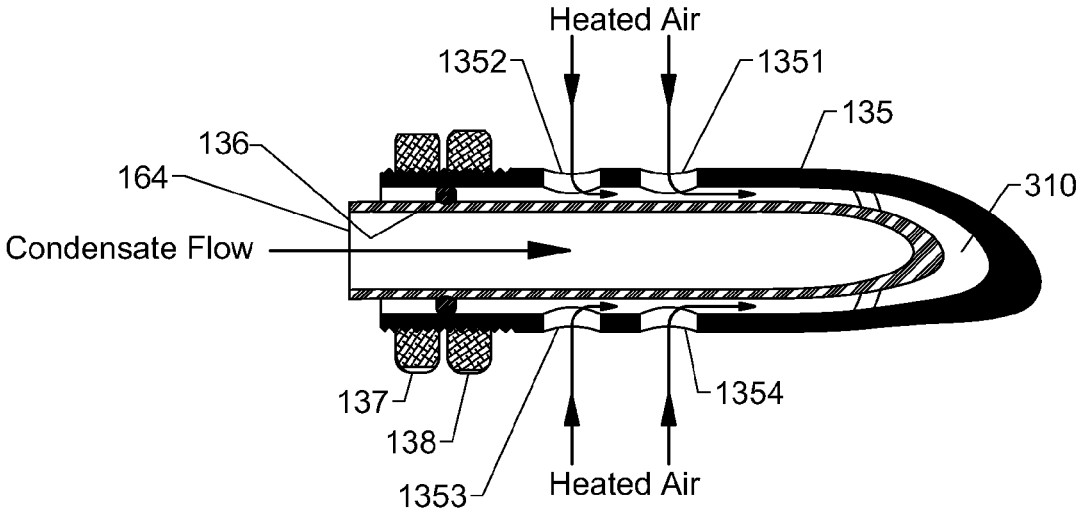
FIG. 31 is a top detail cross-sectional view of part of the drain line conduit and the drain line of FIG. 30, taken along line C-C of FIG. 30, illustrating, among other things, the jam nuts, the intake holes, the interstitial space between the conduit and the drain line, and a seal or o-ring that seals the interstitial space from the outdoor section of the unit.

Further, in the embodiments illustrated, after the condensate drain line (e.g., 163 or 164) attaches to drain line opening 1012 (e.g., via fitting 102) at collector 101, the condensate drain line passes into heating section 293 through jam nut 137 shown in FIGS. 15, 30, and 31 and jam nut 138 shown in FIGS. 18, 30, and 31. In this embodiment, jam nuts 137 and 138 attach conduit 135 to partition 131 shown, for example, in FIGS. 15-18, 28, and 29. Even further, in the embodiments shown, condensate drain line 163 or 164 passes through heating section 293, then through grommet 141 (e.g., shown in FIGS. 15-18, 28, and 30) through partition 133 (shown in FIGS. 28 and 29) and into outdoor section 291, and then through grommet 142 (e.g., shown in FIGS. 15-18, 28, and 30) and partition 134 (shown, for example, in FIGS. 28 and 29) and into return section 292. In the embodiment shown, conduit 135 attaches to floor 132 with jam nuts 139 (e.g., shown in FIGS. 15, 17, 18, 28, and 30) and 140 (e.g., shown in FIGS. 19 and 30). In this embodiment, condensate drain line 163 or 164 can pass through jam nuts 139 and 140 into return air duct 63 as shown in FIGS. 16, 18, 19, 28, and 30, or can exit conduit 135 at cutaway opening 1355 as shown in FIGS. 15 and 17. Grommets 141 and 142 may be similar to grommet 1636 shown in more detail in FIG. **6*a*, for example, and jam nuts 137, 138, 139, and 140 may be similar to jam nuts 1639 and 1640. Other embodiments may route the condensate drain line differently, but in the air conditioning unit illustrated, the routing described and shown avoids components such as the air conditioning evaporator coil (e.g., 610 shown in FIG. 6), and also provides access to where the condensate drain line attaches to the collector and to the condensate drain line at return duct opening 296 or 171**.

In the embodiments illustrated, inducer fan 104, when operating, draws air past burners 431, 432, 433, 434, and 435 (e.g., shown in FIG. 27), of burner assembly or gas manifold assembly 400 (e.g., shown in FIGS. 1-4, 6, 7-8, 11-18, and 27) and draws combustion gasses through condensing gas heat exchanger 300 (e.g., shown in FIGS. 11-18 and 26) and through collector 101 (e.g., shown in FIGS. 20-25 and 28). As described herein, different embodiments may have one or more burners. In the embodiment illustrated in FIGS. 7-9, 14, and 22-25), inducer fan 104 further exhausts the combustion gasses through outlet 105 of inducer fan 104 to outside of enclosure 20 of HVAC unit 2.

Figure 21:
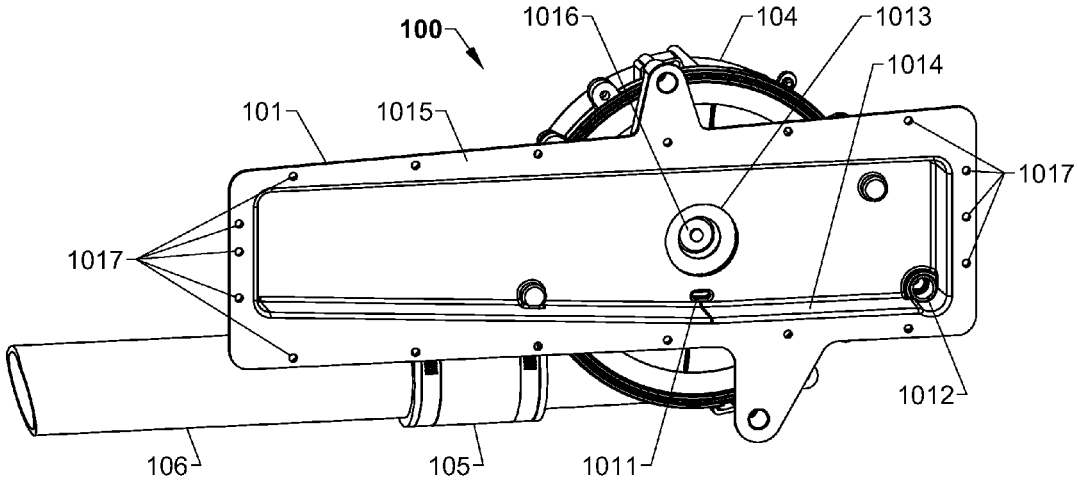
FIG. 21 is an isometric top right rear view of the condensate collector assembly of FIG. 20 that may be part of the air conditioning unit of any of FIGS. 1-4, 6, 7-8, and 11-18, illustrating, among other things, the collector including the drain line opening for connecting to a drain line, the exhaust hole for the inducer fan, and a drain hole below the exhaust hole, for example, for expulsion of the condensate from the unit enclosure, through the inducer fan, with the combustion gasses.

Collector 101 is an example of a collector for a condensing gas heat exchanger (e.g., 300) for an HVAC unit (e.g., air conditioning unit 1, 2, or 3). As shown in FIG. 21, collector 101 includes exhaust hole 1013 for inducer fan 104, in addition to drain line opening 1012 penetrating collector 101, and drain hole 1011 extending through collector 101 to inlet 1016 of inducer fan 104. In the embodiment shown, exhaust hole 1013 for inducer fan 104 is connected to inlet 1016 of inducer fan 104. Further, in the embodiment depicted, when HVAC unit 2 is installed for operation, drain line opening 1012 penetrating collector 101 is lower than exhaust hole 1013 for the inducer fan. Moreover, when HVAC unit 2 is installed for operation, drain hole 1011 is higher than drain line opening 1012, and drain hole 1011 is lower than exhaust hole 1013 for inducer fan 104.

Figure 23:
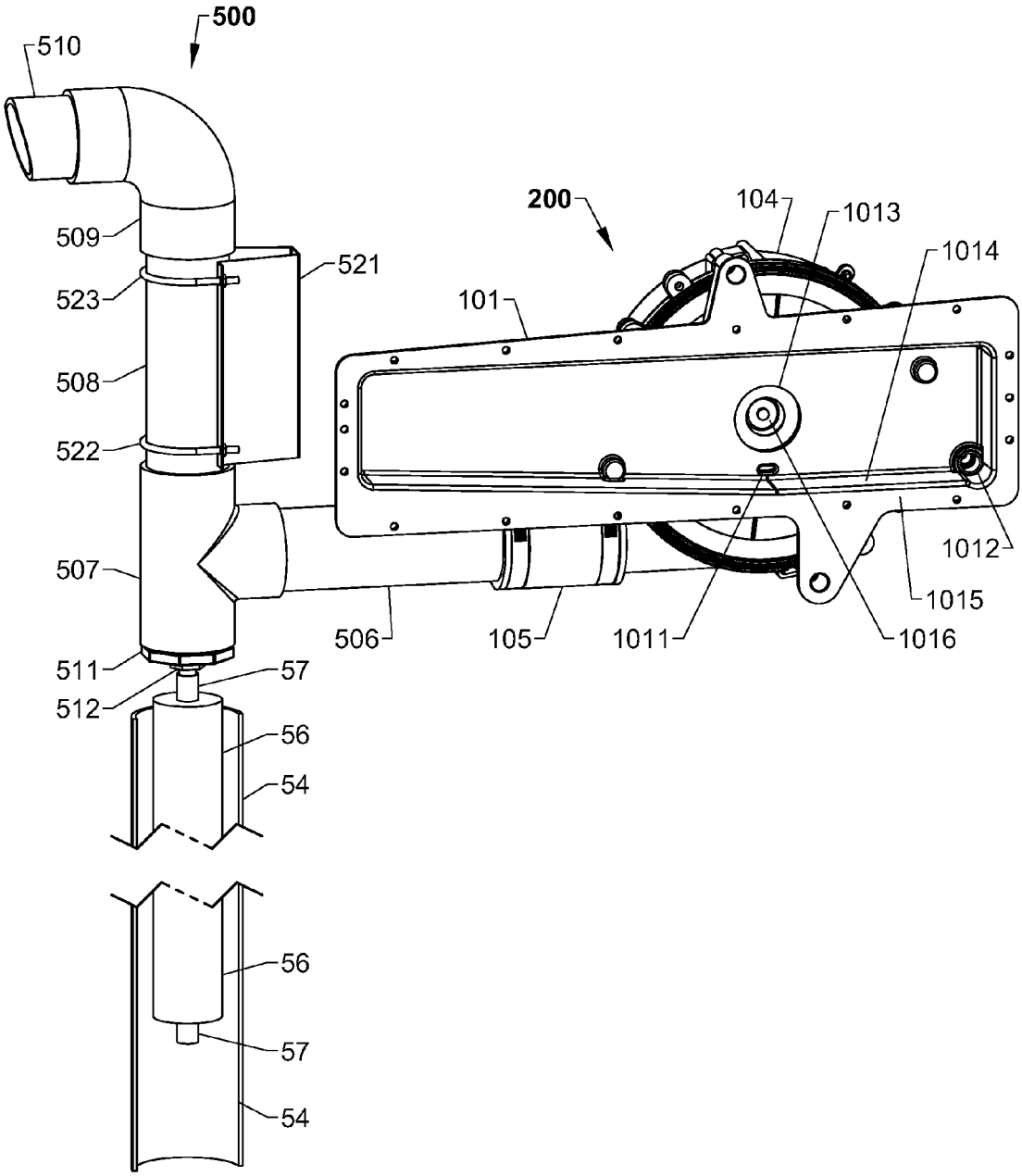
FIG. 23 is an isometric top right rear view of the condensate collector assembly and exhaust conduit or exhaust and drainage assembly of FIG. 22, illustrating, among other things, the collector including the exhaust hole for the inducer fan and the drain hole for expulsion of the condensate from the unit enclosure through the inducer fan, the exhaust conduit or exhaust and drainage assembly for expulsion of the condensate from the unit enclosure with the combustion gasses; the bifurcation that separates the condensate from the portion (e.g., majority) of the combustion gasses; the high path discharging combustion gasses into the atmosphere, and the low path discharging condensate and combustion gasses into the standpipe.

In the embodiment shown, for example, in FIGS. 21 and 23, exhaust hole 1013 for inducer fan 104 is round. In addition, in this particular embodiment, drain line opening 1012 penetrating collector 101 is threaded, as shown, for instance, in FIG. 25, and drain hole 1011 has a smaller cross-sectional area than exhaust hole 1013 for inducer fan 104. In different embodiments, some or a combination of these relationships may exist. Further, in the embodiment illustrated, collector 101 includes flange 1015 (e.g., identified in FIGS. 21 and 23) having a perimeter with multiple holes 1017 spaced around the perimeter for connection of collector 101 to condensing gas heat exchanger 300 of the HVAC unit (e.g., 1, 2, or 3), for instance, at header plate 313 shown in FIG. 26, for example, with multiple fasteners. Such fasteners, and other fasteners described herein, may be screws, bolts, clips, or rivets, as examples. In a number of embodiments, fasteners (e.g., larger fasteners, for instance, bolts or screws) may also secure inducer fan 104 to collector 101, for example, as shown. Collector 101 may be plastic, but may attach to and seal against heat exchanger 300 (e.g., to header plate 313), that may be metal. A gasket, o-ring, seal, or sealing adhesive may be used to form a seal, in some embodiments. The housing of inducer fan 104 may also be plastic.

Various embodiments include a condensate drain line connected to the drain line opening (e.g., 1012, for instance, via fitting 102) penetrating the collector (e.g., 101). Examples include drain line 162 shown in FIGS. 4, 5, 6, and 6*a*; 161 shown in FIGS. 2 and 11; 163 shown in FIGS. 10 and 15; 160 shown in FIGS. 1, 3, and 12; 164 shown in FIGS. 16, 18, 19, and 28-31; and 165 shown in FIG. 17. For instance, FIGS. 10 and 15 show condensate drain line 163 that extends to return duct opening 296 for routing through return duct 63 (e.g., shown in FIGS. 16, 18, 19, and 28) for disposal of the condensate, for instance, within the building. Moreover, a number of embodiments further include a tubular conduit through which the condensate drain line passes. Examples include conduit 1612 shown in FIGS. 2 and 11; conduit 1622 shown in FIGS. 4, 6, 6*a*, and 13; and conduit 135 shown in FIGS. 10, 15-18, and 28. In some embodiments, conduit may be installed first and used to guide the condensate drain line, for example, through the unit or through a roof or a roof curb assembly (or both). In various embodiments, the conduit may be rigid and may be straight or include bends (e.g., as shown). In other embodiments, however, flexible, soft, corrugated, or spiral conduit may be used, as other examples.

In the embodiment illustrated in FIGS. 10, 15-18, and 28 of tubular conduit 135, condensate drain line 163, 164, or 165 passes through tubular conduit 135 between drain line opening 1012 penetrating collector 101 and return duct opening 296 or 171. As shown in FIG. 29, in the embodiment illustrated, condensate drain line 164 and conduit 135 pass through heating section 293. In this embodiment, tubular conduit 135 protects condensate drain line 164 from direct heat from condensing gas heat exchanger 300 where condensate drain line 164 passes through heating section 293. Tubular conduit 135 may be made of a material, such as a metal, that can withstand a high temperature. Examples include aluminum, steel, galvanized steel, aluminized steel, stainless steel, and copper. Drain line 164, on the other hand, or other condensate drain lines described herein, may be flexible, and may be made of a polymer or plastic, for example, such as polyethylene, vinyl, or polyvinylchloride (PVC), as examples. In other embodiments, however, the conduit may be plastic, such as a thermoset plastic or a thermal plastic.

As used herein, an object is considered to be protected from "direct heat" from a particular source of heat if there is a layer of solid material between the object and the source of heat. Most radiant heat from the heat source (e.g., heat exchanger 300) may be prevented from reaching the object (e.g., drain line 164) by the layer of solid material (e.g., conduit 135). But some heat from the heat source may reach the object despite the layer of solid material. For example, convective heat from the heat source (e.g., heat exchanger 300) may reach the object (e.g., drain line 164), or the layer of solid material (e.g., conduit 135) may absorb radiant heat from the heat source (e.g., heat exchanger 300) and then may re-radiate heat, or heat may be transferred by convection, or conduction to the object (e.g., drain line 164), as examples. Multiple modes of heat transfer may occur simultaneously.

Furthermore, in the embodiment shown, condensate drain line 164 passes through outdoor section 291 and tubular conduit 135 protects condensate drain line 164 from freezing where condensate drain line 164 passes through outdoor section 291. As shown in FIG. 31, in the embodiment illustrated, annular interstitial space 310 is formed between or defined by condensate drain line 164 and tubular conduit 135. Further, in the embodiment shown, intake holes 1351, 1352, 1353, and 1354 form inlet passageways from heating section 293 to interstitial space 310. In addition, in this embodiment, cutaway opening 1355, shown in FIGS. 10, 18, and 30, for instance, is an outlet passageway from interstitial space 310 to return section 292. In the embodiment shown, when the unit (e.g., unit 1) is operating, air flows from heating section 293, through inlet passageways 1351, 1352, 1353, and 1354, through interstitial space 310 along condensate drain line 164, and out outlet passageway 1355 to return section 292. This may keep condensate drain line 164 from freezing where condensate drain line 164 passes through outdoor section 291, or may warm drain line 164 at that location. Interstitial space 310 is blocked, in this embodiment, at partition 131 (e.g., at jam nuts 137 and 138) by seal or o-ring 136 shown in FIG. 31 to prevent (e.g., cold) outdoor air from outdoor section 291 from being drawn into interstitial space 310 and therethrough into return section 292 through opening 1355, for example. In some embodiments, similar o-rings may be used at ends of conduits or where jam nuts are used, but in a number of embodiments, similar o-rings may not be needed at other ends of conduits or where other jam nuts are used.

In the embodiment illustrated, return duct opening 296 is open to return section 292. A blower or indoor air fan (not shown) located within enclosure 10 of unit 1 or 3 (e.g., above heat exchanger 300) blows indoor air from return section 292 into heating section 293. As a result, the static pressure within heating section 293 is higher than the static pressure within return section 292. This difference in static pressure causes the airflow from heating section 293, through inlet passageways 1351, 1352, 1353, and 1354, through interstitial space 310, along condensate drain line 164, and out outlet passageway 1355, for example, to return section 292. The flow through interstitial space 310, however, is small in comparison with the flow provided by the indoor air fan, and power losses resulting from the flow through interstitial space 310 are negligible.

Several of the figures illustrate embodiments in which the drain line passes through the return air duct (e.g., 63 or 71). Other embodiments, however, may pass the drain line through the supply duct (e.g., 62). A drain line inside the supply duct will typically also avoid freezing when outdoor air temperatures fall below freezing. In some embodiments, however, drain line routing to the supply duct opening (e.g., 297) may be more problematic, or sufficient pressure differential may not exist to provide flow through the interstitial space (e.g., 310) to avoid freezing where the drain line passes through the outdoor section (e.g., 291) of the unit. In some embodiments, for example, the drain line may be routed through the supply duct (e.g., 62), but the conduit for the drain line may terminate in the return section (e.g., 292) or an outlet passageway (e.g., analogous to 1355) may be provided from the interstitial space (e.g., 310) to the return section (e.g., 292), as other examples. In certain embodiments, as another example, the drain line may be routed through the supply duct (e.g., 62), and the conduit for the drain line may terminate in the heating section (e.g., 293) or near the supply duct opening (e.g., 297) or an outlet passageway (e.g., analogous to 1355) may be provided from the interstitial space (e.g., 310) to the heating section (e.g., 293) or to the supply duct opening (e.g., 297), as still other examples.

In the embodiment shown, inlet passageways 1351, 1352, 1353, and 1354, and outlet passageway 1355 are holes in conduit 135. In other embodiments, however inlet passageways, outlet passageways, or both, may be longer or may include tubing themselves, for instance, connected to the conduit, for example, with a tee. For example, in some embodiments, condensate drain line conduit may pass from the outdoor section (e.g., 291) directly to the return section (e.g., 292) without passing through the heating section. In some such embodiments, however, one or more tubes may extend from the heating section (e.g., 293) to the interstitial space between the drain line and the drain line conduit. These one or more tubes may constitute the inlet passageway(s) described herein, and may provide a pathway for heated air from the heating section to travel through the interstitial space to the return section, to keep the drain line from freezing or to thaw the drain line if it is already frozen. Further, as previously mentioned, in some embodiments, condensate drain line conduit might not go through the return section (e.g., 292), but one or more tubes may extend from the interstitial space (e.g., 310) between the drain line and the drain line conduit to the return section (e.g., 292). These one or more tubes may constitute the outlet passageway(s) described herein, and may provide a pathway for heated air from the heating section to travel through the interstitial space to the return section, to keep the drain line from freezing or to thaw the drain line if it is already frozen. For example, such a drain line may extend outside of the return and supply ducts, or may pass through the supply duct, as examples.

For example, in some embodiments, condensate drain line conduit may pass through the roof outside of either duct and yet may be heated (e.g., through the interstitial space) with warm air from the heating section (e.g., 293) that is delivered to the return section (e.g., 292). In some such embodiments, one or more inlet tubes may extend from the heating section (e.g., 293) to the interstitial space between the drain line and the drain line conduit. These one or more inlet tubes may constitute the inlet passageway(s) described herein, and may provide a pathway for heated air from the heating section to travel through the interstitial space to keep the drain line from freezing or to thaw the drain line if it is already frozen. Further, in some such embodiments, one or more outlet tubes may extend from interstitial space between the drain line and the drain line conduit to the return section (e.g., 292) or to the return air duct (e.g., 61 or 63). These one or more outlet tubes may constitute the outlet passageway(s) described herein, and may provide a pathway for the heated air from the heating section to travel through the interstitial space to the return section or return duct. For example, such a drain line and drain line conduit may extend through the roof as shown in FIG. 2, 4, 6, 11, or 13, as examples.

Air conditioning unit 3, shown in FIGS. 10 and 15, is shipped (e.g., from the manufacturer) with condensate drain line 163 installed in conduit 135 and coiled at return duct openings 296 and 171. In other embodiments, the air conditioning unit may be shipped (e.g., from the manufacturer) with the conduit in place and the installer may pass the condensate drain line through the conduit, as another example. Air conditioning unit 3, shown in FIGS. 10 and 15, is an example of an embodiment having a tubular conduit (e.g., 135) that extends from proximate a drain line opening (e.g., 1012) penetrating the collector (e.g., 101) to the return duct opening for routing the condensate drain line (e.g., 135) from the drain line opening (e.g., 1012) penetrating the collector (e.g., 101) to the return duct opening (e.g., 296 or 171) and through the return duct (e.g., 63 or 71 and 73 shown in FIGS. 16-18) for disposal of the condensate, for example, within the building. In this context, as used herein, "proximate" means within 18 inches, within the same section (e.g., outdoor section), and with no partitions or components blocking routing of the drain line therebetween. In various embodiments, the unit has (e.g., at least one of) a condensate drain line connected to the drain line opening (e.g., 160, 161, 162, 163, 164, or 165) or a tubular conduit (e.g., 135, 1612, or 1622) for passing such a condensate drain line. Some embodiments may include (e.g., supplied by the manufacturer, as shown in FIGS. 10 and 15) both the drain line and the conduit.

Various embodiments include a floor, for instance, of enclosure 10 or 20 or a unit base pan, for example, floor 112 shown in FIGS. 6, 6*a*, and 11-14; or floor 132 shown in FIGS. 15-19, 28, and 29. Certain embodiments are air conditioning units packaged with condensing gas heat exchangers (e.g., 300) that include, for example, a drain line hole in the floor of the enclosure (e.g., 10 or 20) for the unit for passing a drain line (e.g., 160, 161, or 162). Drain line hole 1635 in floor 112 in FIGS. 6, 6*a*, and 11-13 is an example. Floor 112 may be sheet metal, for example, and hole 1635 may be stamped or drilled therein, for instance. Hole 1635 may be round and may be lined with grommet 1636 shown in FIG. 6*a*, for example. Grommet 1636 may be plastic or elastomeric, and may protect the condensate drain line (e.g., 160, 161, or 162) from damage resulting from edges of hole 1635, may reduce air leakage between hole 1635 and the condensate drain line (e.g., 160, 161, or 162), may help to hold the condensate drain line in place, or a combination thereof, as examples.

In various embodiments, such as the embodiment illustrated, drain line hole 1635 is located substantially below the drain line opening (e.g., 1012). This location is for passage of drain line 160, 161, or 162 from drain line opening 1012 through drain line hole 1635, for disposal of the condensate (e.g., within the building). In this context, "substantially below" means within 30 degrees from vertical below opening 1012 or fitting 102. In certain embodiments, drain line hole 1635 is located below drain line opening 1012 or fitting 102 to within 60, 45, 20, 15, 10, 7.5, 5, 4, 3, 2, 1, or 0.5 degrees from vertical, as other examples. In the embodiments illustrated, floor 112 is for embodiments that have a vertical, nearly vertical, substantially vertical, or straight-down condensate drain line (e.g., 160, 161, or 162, for instance, through outdoor section 291) and floor 132 is for embodiments that have an internal drain line (e.g., 163, 164, or 165) or a drain line that passes through the return duct (e.g., 63 or 71). In some embodiments, however, the floor may be the same for both drain line configurations. In some embodiments, in fact, the floor and unit may be configured (e.g., with hole 1635) for a straight-down condensate drain line (e.g., 160, 161, or 162) and the floor and unit may also be configured for an internal drain line (e.g., 163, 164, or 165) or a drain line that passes through the return duct (e.g., 63). In some embodiments, for example, hole 1635 may be partially stamped so that it can easily be punched out in the field by an installer, or may be provided with a plug that the unit installer can install or leave in place if hole 1635 is not used and that the installer can remove or not use if hole 1635 is used for the condensate drain line (e.g., 160, 161, or 162).

In the embodiment illustrated in FIGS. 1-6 and 11-13, condensate drain line 160, 161, or 162 is connected to drain line opening 1012 (i.e., via fitting 102) penetrating collector 101. In these embodiments, condensate drain line 160, 161, or 162 extends vertically downward from drain line opening 1012 (or from fitting 102) through floor 112. As used herein, this means that opening 1012 is above floor 112 and that condensate drain line 160, 161, or 162 is vertical, to within 10 degrees, at least from fitting 102 to floor 112. In other embodiments, the condensate drain line extends substantially vertically downward from the drain line opening through the floor. As used herein, this (substantially vertical) means that the drain line opening is above the floor and that the condensate drain line is vertical, to within 20 degrees, at least from opening 1012 or fitting 102 to floor 112. In still other embodiments, the condensate drain line extends vertically downward, to within 30, 25, 15, 10, 5, 2.5, or 1 degrees, from the drain line opening or fitting through the floor.

In particular embodiments, when the unit (e.g., 1) is installed on the roof (e.g., 4), the tubular conduit (e.g., conduit 1612 shown in FIGS. 2 and 11 or conduit 1622 shown in FIGS. 4, 6, 6*a*, and 13) is substantially vertical at the floor (e.g., 112) of the enclosure (e.g., 10) of the unit (e.g., 1) and the drain line hole (e.g., 1635) in the floor (e.g., 112) is directly below the drain line opening (e.g., 1012 or fitting 102) in the collector (e.g., 101). As used herein, in this context, "substantially vertical" means vertical to within 20 degrees, and "directly below" means vertically below to within 5 degrees. In some embodiments, the tubular conduit is vertical at the floor of the enclosure to within 30, 15, 10, 5, 3, 2, or 1 degrees. And in some embodiments, the drain line hole (e.g., 1635) in the floor is below the drain line opening (e.g., 1012 or fitting 102) in the collector (e.g., 101) to within 30, 20, 15, 10, 3, 2, or 1 degrees from vertical, as other examples. Furthermore, in the embodiments shown in FIGS. 2, 4, and 11, when unit 1 is installed on roof 4, tubular conduit 1612 or 1622 is substantially vertical (i.e., vertical to within 20 degrees) from floor 112 of enclosure 10 of the unit through roof 4 of the building.

Figure 4:
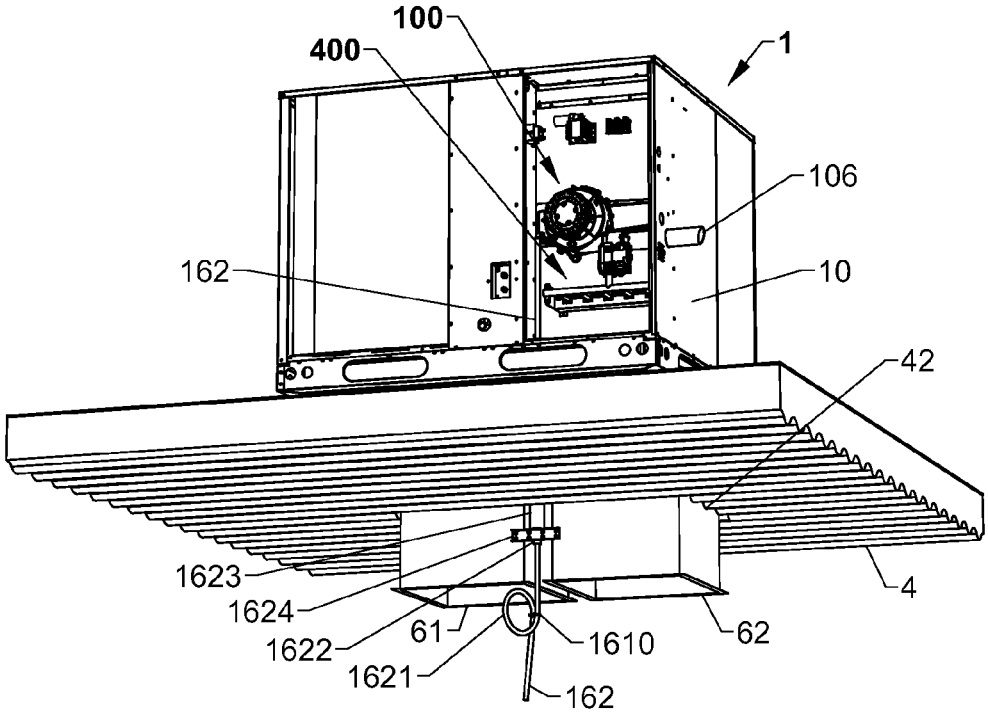
FIG. 4 is an isometric bottom right front view of an example of an air conditioning unit packaged with a condensing gas heat exchanger for efficiently heating and cooling a space that is installed on the roof of a building with a condensate drain line that extends from the unit through a conduit through the same (minimum size) roof penetration as the supply and return ducts, wherein the conduit passes through the roof between the supply and return ducts for disposal of the condensate, for instance, within the building.
Figure 6A:
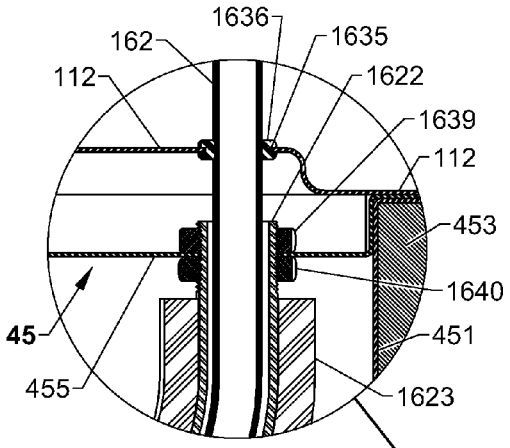
FIG. 6*a* is a detail view of part of FIG. 6 and a detail cut-away left side view of part of the example of an air conditioning unit of FIGS. 4-6 taken along section A-A of FIG. 5 that shows the penetration of the drain line through the floor of the enclosure of the air conditioning unit and the top of the conduit in the roof curb assembly.
Figure 6:
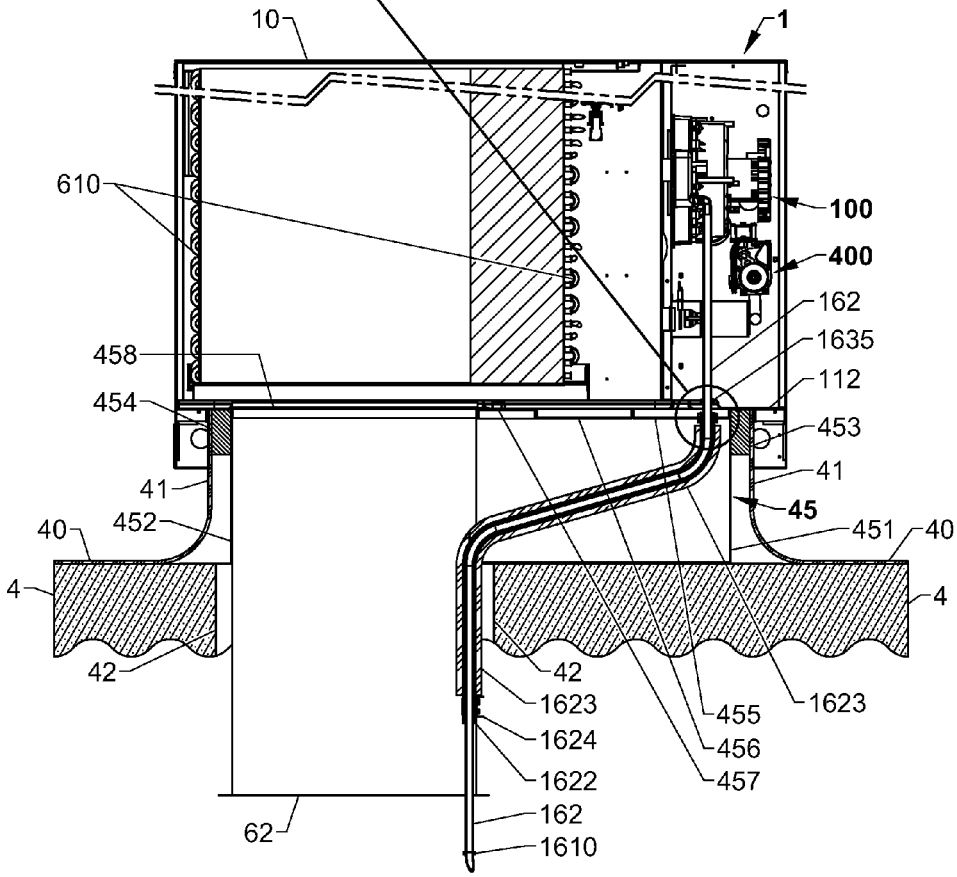
FIG. 6 is a cut-away left side view of the example of an air conditioning unit of FIGS. 4 and 5 taken along line A-A of FIG. 5 that has a condensate drain line that extends through a conduit through the roof curb assembly and through the roof between the supply and return ducts.

On the other hand, in the embodiments shown in FIGS. 4, 6, and 13, tubular conduit 1622 extends from drain line hole 1635 in floor 112 at a slope to return duct 61 and supply duct 62, and through roof 4 of the building between return duct 61 and supply duct 62 through penetration 42. Further, the embodiment illustrated (e.g., in FIG. 6) includes roof curb assembly 45 for supporting unit 1 on roof 4 and containing return duct 61 and supply duct 62. In the embodiment shown, roof curb assembly 45 includes tubular conduit 1622 therethrough for passage of condensate drain line 162, for example, for disposal of the condensate, for instance, within the building. As illustrated, tubular conduit 1622 extends from floor 112, through roof curb assembly 45, and through roof 4 of the building, through penetration 42. In this embodiment, the smaller penetration 42 is used without needing additional penetration 44 (shown in FIG. 2, for example) for the drain line.

Figure 5:
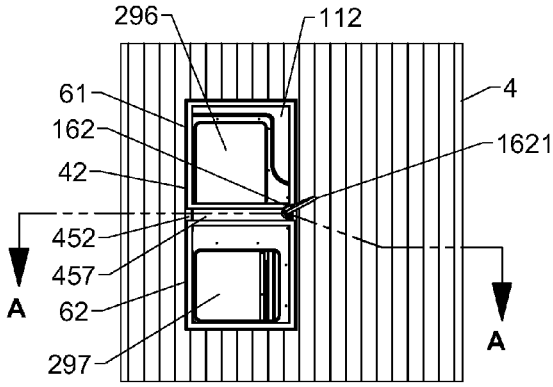
FIG. 5 is a bottom view of the example of an air conditioning unit of FIG. 4 that has a condensate drain line that extends through a conduit through the roof between the supply and return ducts for disposal of the condensate, for example, within the building.

Moreover, in the embodiment shown, tubular conduit 1622 extends from vertically below drain line opening 1012 (e.g., at floor 112), bends less than 90 degrees, and then continues at a slope through roof curb assembly 45 to supply duct 62 (shown in FIGS. 6 and 13) and return duct 61, and through roof 4 of the building between return duct 61 and supply duct 62. As used herein, a conduit (e.g., 1622) extends "to" a duct (e.g., 61 or 62) if the conduit comes to within twelve (12) inches from the duct. Further, as used herein, if a conduit passes between two ducts, and the ducts are closer together than their major cross-sectional dimension, then the conduit is said to extend "to" the two ducts. In some embodiments, such as illustrated in FIGS. 5, 6, and 13, the conduit (e.g., 1622) extends to within 12, 5, 4, 3, 2, or 1 inches from one or both ducts (e.g., 61 and 62), as further examples.

As shown in FIGS. 6 and 13, in the embodiment shown, there is a second bend of less than 90 degrees in conduit 1622 at ducts 61 and 62 from the sloped section to a further substantially vertical section of the conduit and drain line. The slope (e.g., between the two bends) may be, for example, (e.g., when the unit, roof curb assembly, and conduit are properly installed), more than zero degrees but less than 90 degrees from horizontal, more than zero degrees but less than 45 degrees from horizontal, more than zero degrees but less than 30 degrees from horizontal, more than five degrees but less than 30 degrees from horizontal, or more than five degrees but less than 20 degrees from horizontal, as examples of ranges. The embodiment shown (e.g., in FIGS. 6, 6*a*, and 13) includes insulation 1623 (e.g., foam) around conduit 1622. Other embodiments, on the other hand, may omit insulation (e.g., as shown in FIGS. 3, 12, 15-19, and 28-30) or may have insulation directly on the condensate drain line rather than surrounding a conduit (e.g., insulation 56 on low path 57, which may be a drain line or hose, as shown in FIGS. 22 and 23), as other examples.

Further, as shown in FIGS. 4, 6, and 13, conduit 1622 is supported from ducts 61 and 62 by mounting bracket 1624. As shown in FIG. 6*a*, conduit 1622, in the embodiment illustrated, is also supported from roof curb top front close-out pan 455 of roof curb assembly 45 by jam nuts 1639 and 1640. Moreover, FIG. 6*a* also shows roof curb front long side panel 451 and roof curb front panel wooden nail rail 453, and FIG. 5 shows roof curb rear long side panel 452 and roof curb long duct support 457 that supports ducts 61 and 62 from roof 4, which are components of roof curb assembly 45, in the embodiment shown. In addition, FIG. 6 shows roof curb front long side panel 451, roof curb front panel wooden nail rail 453, roof curb rear long side panel 452, roof curb short duct support 458, and roof curb rear panel wooden nail rail 454, which are also components of roof curb assembly 45, in the embodiment illustrated. FIG. 6 also shows roof curb top front close-out pan 455, roof curb top center close-out pan 456, and roof curb long duct support 457. Other embodiments may differ.

Figure 2:
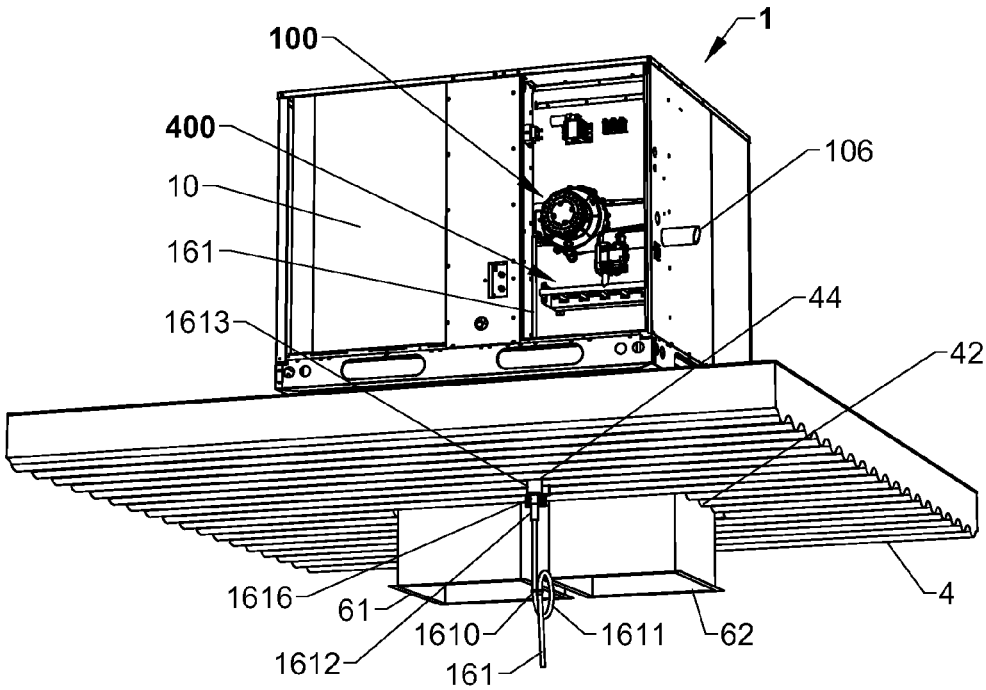
FIG. 2 is an isometric bottom right front view of an example of an air conditioning unit packaged with a condensing gas heat exchanger for efficiently heating and cooling a space that is installed on the roof of a building with a condensate drain line that extends from the unit through a conduit through a separate roof penetration than the supply and return ducts for disposal of the condensate, for instance, within the building.
Figure 3:
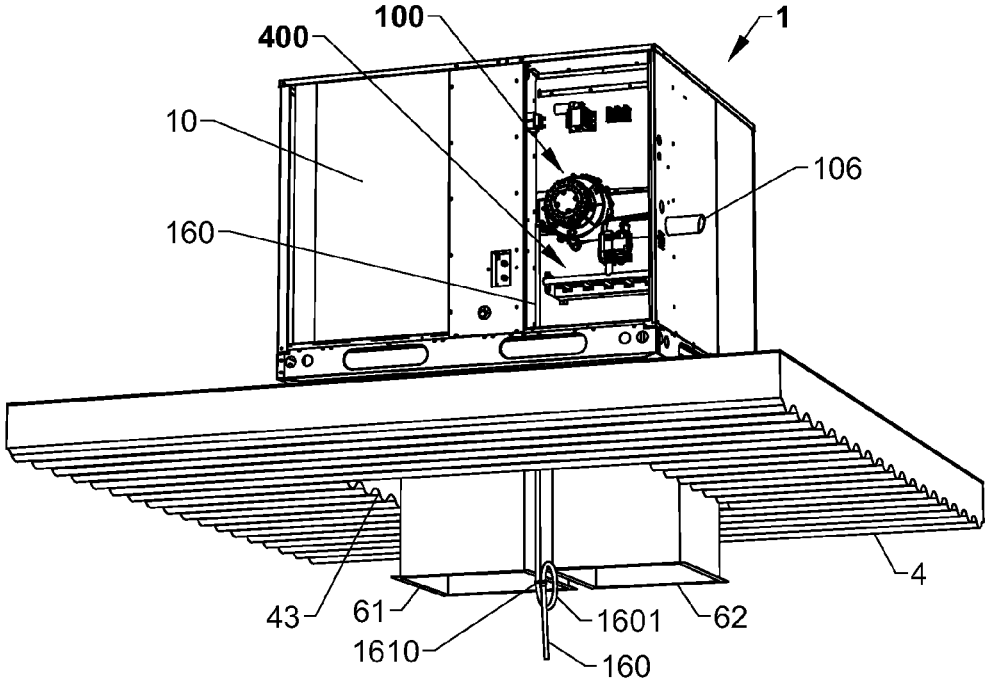
FIG. 3 is an isometric bottom right front view of the example of an air conditioning unit of FIG. 1 that has a condensate drain line that extends through the same enlarged roof penetration as the supply and return ducts for disposal of the condensate, for example, within the building, and that does not use a conduit for the drain line.
Figure 11:
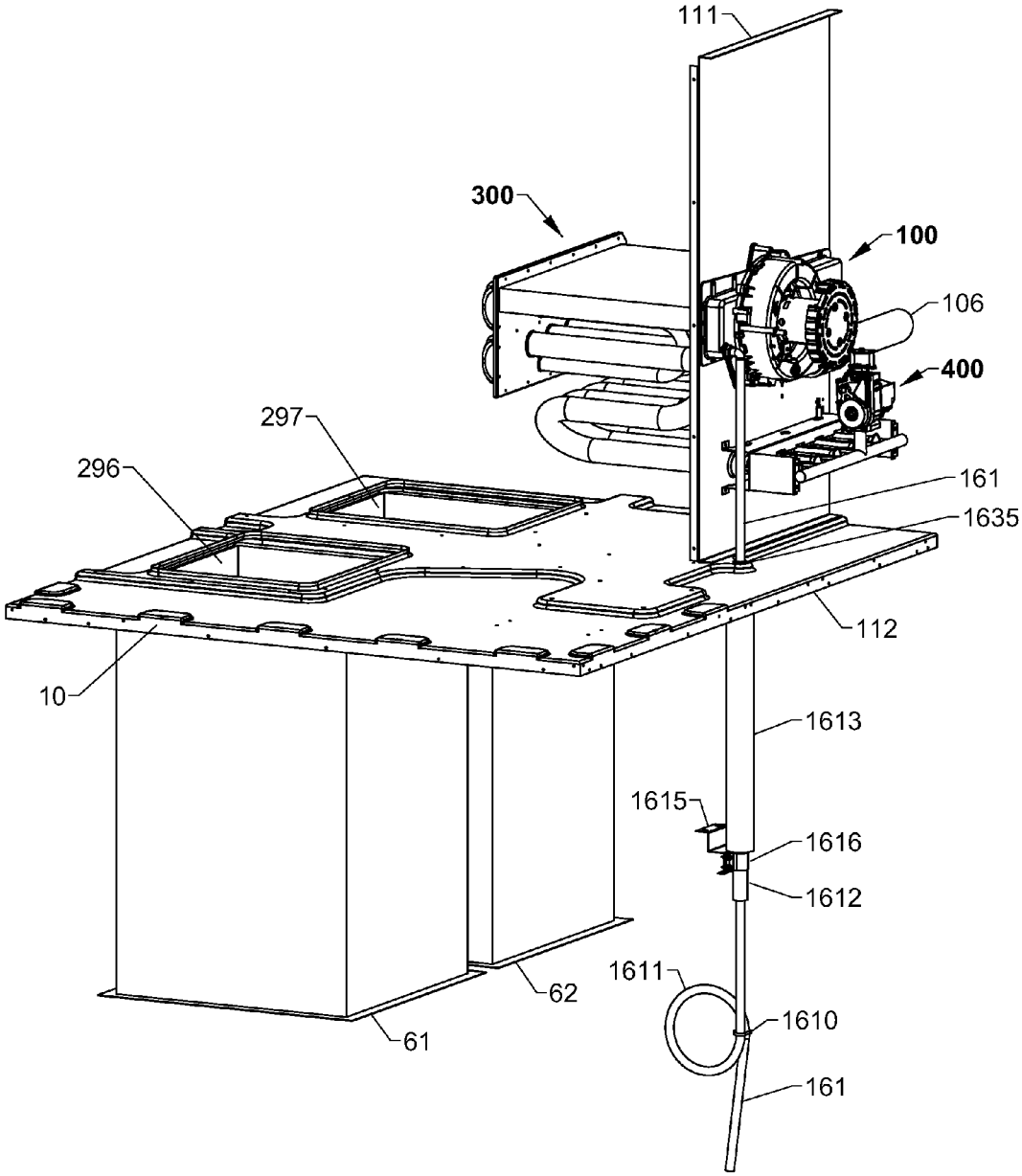
FIG. 11 is an isometric top left front view of the example of an air conditioning unit of FIG. 2 drawn with many of the components omitted to better illustrate the remaining components, and illustrating the condensing gas heat exchanger, condensate collector assembly including the inducer fan, burner assembly or gas manifold assembly, and condensate drain line that extends from the collector assembly vertically downward through the floor of the unit through the insulated conduit, and on vertically downward, for instance, through the roof of the building, and that forms a loop or trap, for example, within the building.

Further, FIGS. 11 and 12 illustrate embodiments where condensate drain line 160 or 161 extends vertically downward from drain line opening 1012 (i.e., from fitting 102) penetrating collector 101 through floor 112 and on vertically downward (i.e., vertical to within 10 degrees) through roof 4 (shown in FIGS. 1 and 2) of the building for disposal of the condensate (e.g., within the building). As shown in FIG. 2, in some such embodiments, the drain line passes through the roof through a separate penetration (e.g., penetration or round hole 44) than the penetration (e.g., 42) for the return and supply air ducts 61 and 62. As illustrated in FIG. 3, however, in other embodiments, roof penetration 43 may be used that is larger and extends to the drain line (e.g., 160) so that a single penetration is used for the return and supply ducts (e.g., 61 and 62) and the vertical or substantially vertical condensate drain line (e.g., 160). In the embodiment shown in FIGS. 2 and 11, drain line 161 passes through conduit 1612 which is surrounded by insulation 1613. In this embodiment, conduit 1612 is supported by brackets 1615 and 1616 from roof 4. In embodiments where a conduit (e.g., 1612 or 1622) is used, the conduit may facilitate installation by guiding the condensate drain line (e.g., 161 or 162) through the roof curb (e.g., 45 shown in FIG. 6), the roof (e.g., 4), a roof penetration or hole (e.g., 44 shown in FIG. 2), or a combination thereof, for instance, after the unit is installed. The conduit, insulation, or both, may help to prevent the drain line from freezing. In the embodiments illustrated, neither heated air nor combustion gasses are circulated through conduit 1612 shown in FIGS. 2 and 11 or conduit 1622 shown in FIGS. 4, 6, 6*a*, and 13. But in other embodiments, air from the space, combustion gasses (e.g., from heat exchanger 300), or air heated by heat exchanger 300 may be circulated through such conduits (e.g., within an interstitial space therein between the conduit and drain line) to keep the drain line from freezing. In some embodiments, for example, the conduit may extend into the space in the building and air from the space may be drawn through the conduit, through the interstitial space, for example, to the return section of the unit to warm the condensate drain line. In still other embodiments, drain lines may be prevented from freezing or may be thawed using an electrical resistance heating element or wire, as another example.

Figure 22:
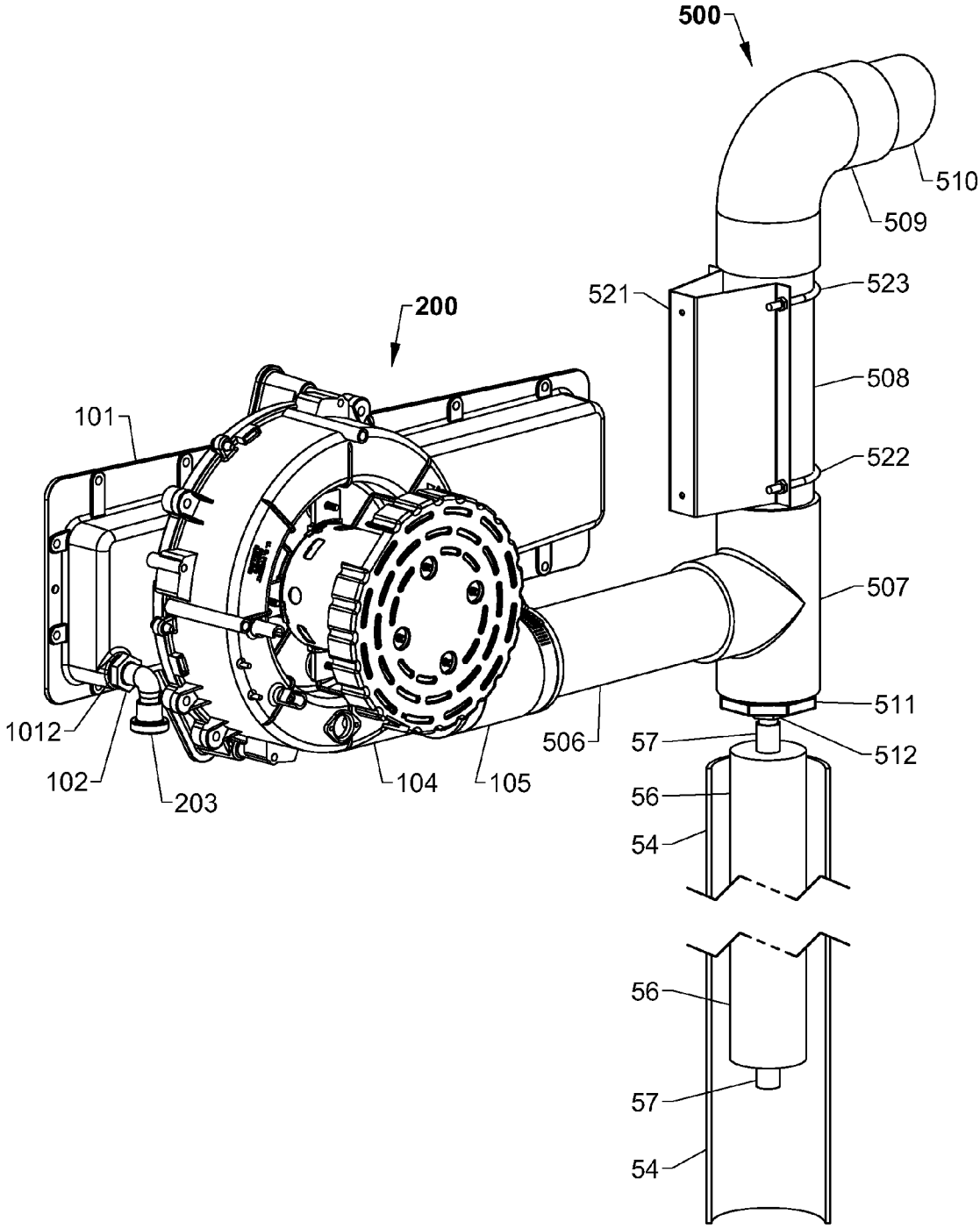
FIG. 22 is an isometric top left front view of the condensate collector assembly of FIGS. 20 and 21 connected to the exhaust conduit or exhaust and drainage assembly of FIGS. 7-9, illustrating, among other things, the inducer fan, the collector including a plug in the drain line opening for connecting to a drain line, the exhaust conduit or exhaust and drainage assembly for expulsion of the condensate from the unit enclosure with the combustion gasses; a bifurcation that separates the condensate from a portion (e.g., majority) of the combustion gasses; a high path discharging combustion gasses into the atmosphere, and a low path discharging condensate and combustion gasses into a standpipe.
Figure 24:
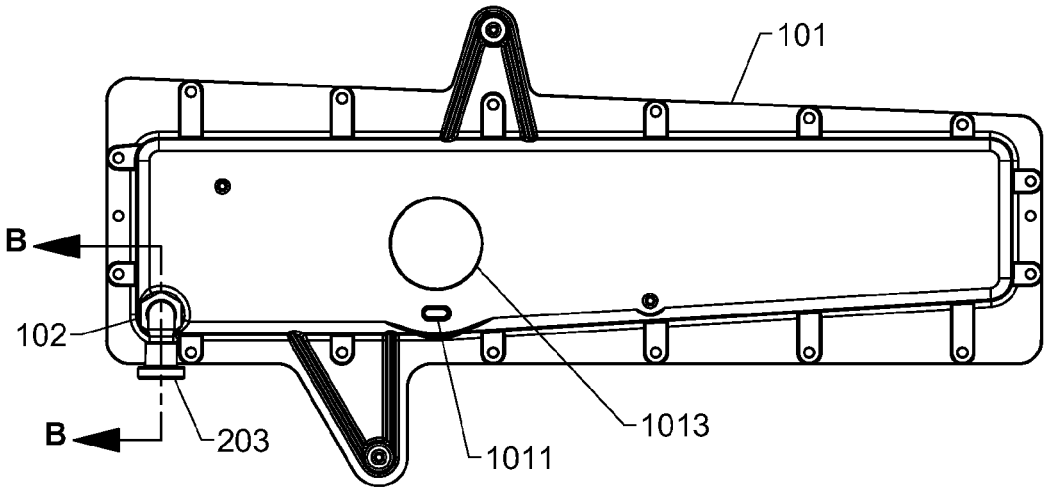
FIG. 24 is a front view of the collector that is part the condensate collector assembly of FIGS. 20-23 and that is fitted with the plug shown in FIG. 22 in the drain line opening for connecting to a drain line, configuring the collector for expulsion of the condensate from the unit enclosure with the combustion gasses, for example, through the exhaust conduit or exhaust and drainage assembly of FIGS. 7-9, 14, 22, and 23.
Figure 25:
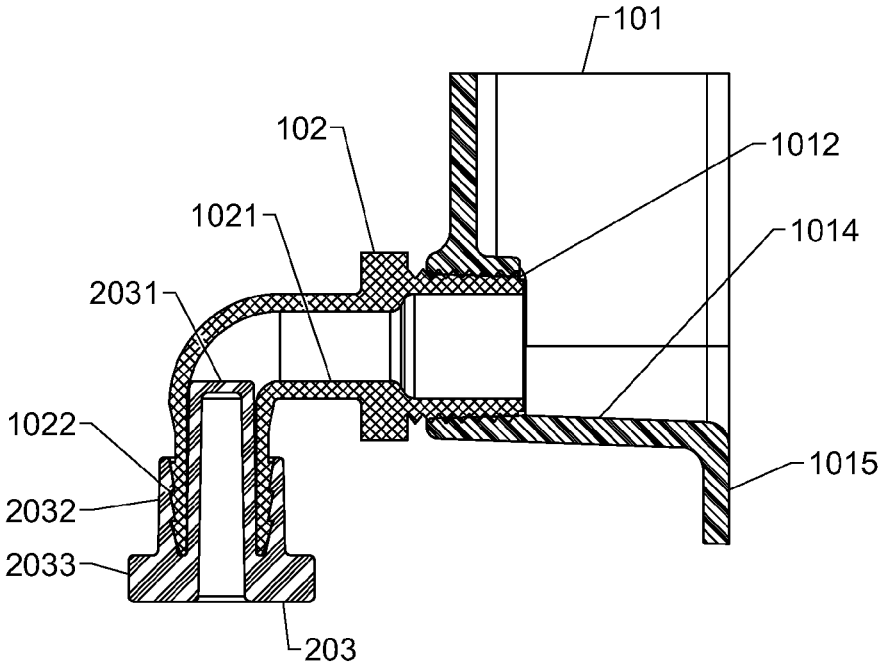
FIG. 25 is a detail right side cutaway view of part of the collector taken along line B-B in FIG. 24 that illustrates the drain line opening, fitting, and the plug shown in FIG. 22, configuring the collector for expulsion of the condensate from the unit enclosure through the inducer fan with the combustion gasses, for example, through the exhaust conduit or exhaust and drainage assembly of FIGS. 7-9, 14, 22, and 23.

FIGS. 22, 24, and 25 illustrate plug 203 that is installed in drain line opening 1012 (i.e., in fitting 102) penetrating collector 101 in some embodiments in applications where the condensate passes through the inducer fan rather than through a drain line connected to drain line opening 1012 (e.g., via fitting 102). As used herein, a cap is considered to be a type of "plug". In the embodiment illustrated, plug 203 both surrounds part of fitting 102 and extends inside of fitting 102. In other embodiments, a plug may just fit inside the fitting or opening without surrounding part of the fitting or may just surround part of the fitting without fitting inside. Plug 203 is a press in (and on) plug and outside wall 2032 of plug 203 engages barbs 1022 on the outside of fitting 102 while end 2031 of plug 203 fits inside fitting 102. A person can install or remove plug 203 by grasping head 2033 by hand or with a tool such as pliers, for example. Other embodiments of plugs (e.g., corresponding to plug 203) may be threaded, as another example.

Further, as shown in FIG. 25, when the unit is properly installed, in embodiments and applications where plug 203 is used, end 2031 of plug 203, is flush and level with horizontal inside bottom surface 1021 of fitting 102, or substantially flush and level. This minimizes the amount of condensate (water) that collects within fitting 102 and reduced the chance that fitting 102 or collector 101 will be damaged if condensate therein freezes. This configuration may also reduce the chance that such freezing will push plug 203 out of fitting 102 which would later spill condensate inside the unit (e.g., onto floor 112 of enclosure 20 of unit 2). In the embodiment illustrated, plug 203 is made of an elastomer and has an interference fit with fitting 102. In other embodiments, the plug may be plastic, such as PVC or polyethylene. Further, in the embodiment illustrated (e.g., in FIG. 25), a small layer of condensate may remain on bottom surface 1014 of collector 101 behind the bottom wall thickness of fitting 102. This small layer of condensate could freeze, particularly if the unit is left off when ambient conditions are sufficiently below freezing. In the embodiment illustrated, however, this small layer of ice formation on bottom surface 1014 does not cause a problem. Other embodiments, however, may be configured to avoid such a small layer of condensate from remaining on the bottom surface (e.g., 1014) of the collector (e.g., 101), for instance, behind the bottom wall thickness of a fitting (e.g., 102) at the drain opening (e.g., 1012).

A number of embodiments include an exhaust conduit (e.g., 106, 506, or exhaust and drainage assembly 500) extending from the outlet (e.g., 105) of the inducer fan (e.g., 104) to the outside of the enclosure (e.g., 10 or 20). In the embodiment shown, a coupling at outlet 105 connects inducer fan 104 to pipe or exhaust conduit 106 or 506. See, for example, FIGS. 20-23. This coupling may be made of an elastomeric material (e.g., a short section of hose) clamped to outlet 105 of inducer fan 104 and to pipe or exhaust conduit 106 or 506), for example. Use of an elastomeric material for this coupling (e.g., at outlet 105) may reduce the transfer of noise and vibration from inducer fan 104 to exhaust conduit 106 or 506, for instance. In the embodiments shown in FIGS. 7-9, 14, and 22-25, condensate formed in condensing gas heat exchanger 300 passes from collector 101 through drain hole 1011 extending through collector 101 to inlet 1016 of the inducer fan 104. The condensate then travels through inducer fan 104, through exhaust conduit 506 (part of exhaust and drainage assembly 500), and out of enclosure 20 with the combustion gasses. Moreover, in this particular embodiment, the exhaust conduit or exhaust and drainage assembly 500 has a bifurcation 507 (e.g., a Tee) that separates the condensate from a majority of the combustion gasses. Further, the exhaust conduit, bifurcation 507 or exhaust and drainage assembly 500 includes a high path (e.g., 508 of assembly 500) and a low path (e.g., 57, for example, a drain line or hose attached via reducer 511 and hose fitting 512, of assembly 500 in the embodiment shown).

In the embodiment illustrated, high path 508 of exhaust conduit or exhaust and drainage assembly 500 includes the vertical section of pipe shown, elbow 509, and horizontal pipe 510. Other embodiments may be routed differently. In a number of embodiments, however, such as the embodiment shown, the high path (e.g., 508 including 509 and 510) has a larger cross sectional area than the low path (e.g., 57), and the majority (i.e., by volume) of the combustion gasses pass through the high path (e.g., 508) when unit 2 is operating as a furnace. In the embodiment shown, a minority (i.e., by volume) of the combustion gasses pass through low path 57 with the condensate. This minority of the combustion gasses may keep the condensate within low path 57 from freezing when ambient temperature conditions are below freezing by warming low path 57 of exhaust and drainage assembly 500. In some embodiments, such as shown in FIGS. 22 and 23, insulation 56 further helps to keep low path or drain line 57 warm to prevent condensate therein from freezing. In a number of embodiments, the low path (e.g., 57) may have a continually downward gradient, for example, so that condensate does not collect in the low path and freeze when the unit or furnace is not operating and when ambient temperature conditions are below freezing.

In the embodiment shown in FIGS. 7-9 and 22-23, low path 57 discharges into vertical standpipe 54. As used herein, unless stated otherwise, a "vertical standpipe" is vertical to within ten degrees. In other embodiments, a "substantially vertical standpipe" is vertical to within 15 degrees. In still other embodiments, a standpipe may be vertical to within 7.5, 5, 4, 3, 2, or 1 degrees, as other examples. In the embodiment shown, vertical standpipe 54 is substantially larger in diameter, cross-sectional dimension, or cross-sectional area than low path 57. As used herein, "substantially larger in diameter means having at least twice the diameter, and substantially larger in cross-sectional area means having at least four times the cross-sectional area. As shown in FIGS. 22 and 23, insulation 56 on low path 57 has a smaller outside diameter than the inside diameter of standpipe 54. In a number of embodiments, the condensate is allowed to drip into vertical standpipe 54 from low path 57. As shown in FIGS. 22 and 23, in a number of embodiments, low path 57 extends into stand pipe 54 and the minority of the combustion gasses emerging from low path 57 into standpipe 54 are exhausted upward between low path 57 and standpipe 54 (e.g., between the outside of insulation 56 and the inside of standpipe 54). In some embodiments, this upward flow of warm exhaust gas (i.e., combustion gasses) further warms low path 57 and the inside of standpipe 54, in the embodiment shown, preventing the condensate therein from freezing. Further, in the embodiment shown, exhaust and drainage assembly 500 is attached to enclosure 20 for support via mounting bracket 521 and U-bolts 522 and 523 shown, for example, in FIGS. 22 and 23.

As shown in FIGS. 7-9, in various embodiments, unit 2 is installed at ground level (e.g., on a concrete slab located on the ground, for instance, at ground level 80 shown in FIG. 9) and standpipe 54 extends into the ground and terminates with at least one opening (e.g., holes 52 shown in FIG. 8) to the ground. In a number of embodiments, this opening may be, for example, below the frost line (e.g., 81) in the ground. Furthermore, in a number of embodiments, the condensate is directed to discharge into a bed of neutralizing media or porous alkaline material 82, such as limestone, which may have been placed in the ground to neutralize acidity of the condensate. The condensate may percolate from this porous bed (e.g., 82) into the ground. As shown in FIG. 7, in some embodiments, standpipe 54 is a straight plain end pipe that simply terminates (e.g., below the frost line) in the ground or in the bed of neutralizing media or porous alkaline material (e.g., 82). Such embodiments may be suitable for sandy or porous soils, for example. As shown in FIG. 8, however, in other embodiments, standpipe 54 connects to a horizontal pipe (e.g., below the frost line) in the ground or in the bed of neutralizing media or porous alkaline material (e.g., 82), that contains multiple openings (e.g., holes). Perforated sleeve or pipe 52 shown in FIG. 8 is an example of such a horizontal pipe, which is connected to standpipe 54 with elbow 53. Perforated sleeve or pipe 52, standpipe 54, and elbow 53 may be plastic pipe, and may be made of a thermoplastic, such as PVC, polyethylene, or ABS (acrylonitrile butadiene styrene), as examples.

In still other embodiments, standpipe 54 may connect to a trap below the frost line, and then into a sewer or septic system. Further, in certain embodiments, unit 2 may be installed on a roof and standpipe 54 may extend into a building, for example, for disposal into a sewer or septic system. Precautions may be advisable, however to prevent the minority of the combustion gasses that passes through the low path (e.g., 57) from entering a sewer, building, or other enclosed space where a sufficiently high concentration of combustion gasses (i.e., carbon dioxide) may pose a hazard to occupants. For this reason, the condensate drain line configurations illustrated in FIGS. 1-6, 11-13, 15-19, and 28-29 may be better for installations that drain condensate into a building or into a sewer. In the embodiments of FIGS. 1-6, 11-13, 15-19, and 28-29, since the condensate is taken from collector 101 on the suction side of inducer fan 104, any failure of a trap or drain line (e.g., with in the building or occupied space) would result in indoor air (e.g., from within the building) or sewer gasses (e.g., from the sewer that the drain line drains into) being drawn up the drain line into the collector rather than combustion gasses flowing out of the drain line into the building or sewer.

As illustrated, the embodiments of FIGS. 1-6, 11-13, 15-19, and 28-29, in which the condensate is taken from collector 101 on the suction side of inducer fan 104, may include a trap to prevent air from within the building or sewer gasses from traveling up through the drain line to collector 101 and out through inducer fan 104. The trap also avoids having a higher static pressure within the drain line (e.g., at or just below drain line opening 1012), that may interfere with drainage of condensate from collector 101 into the drain line (e.g., through drain line opening 1012). By preventing air from within the building or sewer gasses from traveling up through the drain line and into the collector, the trap prevents such a flow of air from blowing condensate away from drain line opening 1012, which may interfere with proper drainage from collector 101. In some embodiments, the trap is formed using a S shape or a loop in the drain line itself. Examples include trap 1601 in drain line 160 in FIGS. 1, 3, and 12; trap 1611 in drain line 161 in FIGS. 2 and 11; trap 1621 in drain line 162 in FIGS. 4, 5, and 13; trap 1641 in FIGS. 16, 19, 28, and 30; and trap 1651 in FIG. 17. In the embodiment shown in FIGS. 1-4 and 11-13, for example, the trap is formed by making a loop in the tubing (i.e., drain line) and securing the loop with tie 1610. Tie 1610 may be metal or plastic, for example, and may form a loop or S shape, for example. Other embodiments may use a molded loop or S trap, as other examples.

In many embodiments that have a trap and have the condensate drain line connected to the collector (e.g., 101) on the suction side of the inducer fan (e.g., 104), if there is not sufficient water in the trap, or if there is a breach in the drain line above the trap within the building, for example, air or sewer gasses would flow from within the building into the collector (e.g., 101) and out of the unit through the inducer fan (e.g., 104) and the exhaust conduit (e.g., 106), rather than combustion gasses from the heat exchanger (e.g., 300) and collector (e.g., 101) flowing into the building or sewer. If there is no water in the trap, airflow through the drain line may partially or fully prevent condensate from flowing through the drain line until the unit cycles off. When the unit cycles off, however, and the inducer fan (e.g., 104) turns off, condensate may flow from the collector though the drain line and fill the trap. Once the trap contains sufficient water (condensate) to prevent airflow though the drain line, in a number of embodiments, condensate will flow through the drain line unimpeded by airflow in an opposite direction.

Further, certain embodiments are or include a particular apparatus for passing a tube through a wall of a duct, for forming a trap with the tube, or both. Examples (e.g., apparatus 150 and 170) are illustrated in FIGS. 16, 17, 19, and 28. In the embodiments illustrated, apparatuses 150 and 170 each include, for example, plate 155 or 175 having bend 156 or 176 extending across the plate (e.g., 155 or 175). In a number of embodiments, the bend (e.g., 156 or 176) may separate the plate (e.g., 155 or 175) into a first portion (e.g., 157 or 177) and a second portion (e.g., 158 or 178). Plates 155 and 175 may be made of sheet metal, in a number of embodiments, for example, galvanized steel, aluminum, or aluminized steel, which may be cold bent at bend 156 or 176. In other embodiments, as another example, plates 155 and 175 may be made of plastic, which may be formed or molded with bend 156 or 176 therein. In either of such embodiments, the first portion (e.g., 157 or 177) is connected to the second portion (e.g., 158 or 176) at the bend (e.g., 156 or 176).

In various embodiments, the first portion (e.g., 157 or 177) is at a non-zero angle to the second portion (e.g., 158 or 178), also at the bend (e.g., 156 or 176). As used herein, a non-zero angle is an angle of five degrees (measured from being straight) or more. Such a bend may be a sharp bend or may formed by curvature or multiple sharp bends, as examples. In a number of embodiments, for example, where the bend is formed by curvature or multiple sharp bends, the bend may extend over a dimension of the plate that is less than a particular fraction of an overall dimension of the plate (e.g., 155 or 175). That overall dimension may be length or width of the plate or length or width of the first portion (e.g., 157 or 177) or the second portion (e.g., 158 or 178), as examples. In certain embodiments, for instance, the fraction may be 3, 5, 10, 15, 20, 25, 30, 35, 40, 45, or 50 percent of the overall dimension, as examples.

In the embodiment shown, the non-zero angle at the bend (e.g., bend 156 or 176) is a right angle or a 90-degree bend. As used herein, a right angle is 90 degrees plus or minus 10 degrees. In other embodiments, the non-zero angle at the bend (e.g., bend 156 or 176) may be, for example, 10, 20, 30, 40, 50, 60, 70, 80, 85, 95, 100, 110, 120, 130, or 135 degrees, as examples, each plus or minus 5 degrees, measured from straight (no bend). In certain embodiments, the non-zero angle at the bend (e.g., bend 156 or 176) may be, for instance, between 45 degrees and 135 degrees, between 60 degrees and 120 degrees, between 70 degrees and 110 degrees, between 75 degrees and 105 degrees, or between 80 and 100 degrees, as examples.

In the embodiments illustrated, for example, in FIGS. 16 and 17, first portion 155 or 175 has first hole 151 sized and shaped for passage of the tube (e.g., condensate drain line 164 or 165). Hole 151 may be round or elliptical, for example, and may have an inside diameter that is equal to or slightly greater than an outside diameter of the tube (e.g., condensate drain line 164 or 165). In certain embodiments, however, hole 151 may have an inside diameter that is equal to or slightly less than an outside diameter of the tube (e.g., condensate drain line 164 or 165), thus creating an interference fit with the tube and avoiding leakage (e.g., of air) between the tube and hole 151. Such an interference fit, however, may make installation of the tube difficult. For this reason, a slight clearance fit may be preferable, in a number of embodiments.

Further, in the embodiments shown, second portion 158 or 178 has second hole 152 sized and shaped for passage of the tube (e.g., condensate drain line 164 or 165) and third hole 153, also sized and shaped for passage of the tube. Holes 152 and 153 may be sized and shaped as described above for hole 151, for example. In the case of holes 152 and 153, however, avoiding leakage between the inside of the hole and the tube may not be a consideration. But a sufficiently close fit or even an interference fit, in some embodiments, may be beneficial to hold the tube in position to form loop or trap 1641 or 1651. In some embodiments, the tube may be held in place (e.g., to form loop or trap 1641 or 1651) with a clamp, an adhesive, tape, a grommet, or a combination thereof, as examples.

Moreover, in the embodiments shown, first portion 157 or 177 also has multiple fourth holes 154 which are sized and shaped for passage of fasteners. Such fasteners may be sheet metal screws, for instance that pass through the multiple fourth holes 154 and screw into the wall of the duct (e.g., 63 or 73) from the outside of the duct to attach the first portion 157 or 177 to the duct. In other embodiments, on the other hand, the fasteners, or other fasteners described herein, may be clips (e.g., push clips, which may be plastic or metal wire, as examples), or pop rivets, for instance, and may attach to the wall of the duct (e.g., 63 or 73). Further, each of the multiple fourth holes 154 may be substantially smaller in diameter than first hole 151, second hole 152, third hole 153, or a combination thereof. In this context, substantially smaller in diameter means half of the diameter or less. In the embodiment illustrated, first portion 157 and first portion 177 each have four fourth holes 154. Further, in the embodiment illustrated, first portion 157 and first portion 177 are each rectangular and have one of the fourth holes 154 in each corner. Other embodiments may have 1, 2, 3, 5, 6, 7, 8, 9, 10, or 12 fourth holes that are sized and shaped for passage of fasteners, as other examples. Still other embodiments may have one or more tabs that fit inside the duct (e.g., 63 or 73) at one end of the first portion (e.g., 157 or 177) and one or multiple fourth holes 154 that are sized and shaped for passage of one or more fasteners at the other end. Even further, some embodiments may have tabs at both ends. Other embodiments may attach with an adhesive, with a clamp, or with tape, as other examples.

Furthermore, in the embodiment shown, the first portion (e.g., 157 or 177) of the apparatus (e.g., 150 or 170) is configured to seal an opening (e.g., access opening 631 shown in FIG. 19) in the wall of the duct (e.g., 63 or 73 in FIGS. 16 and 17) by placing the first portion (e.g., 157 or 177) over the opening (e.g., 631) with the second portion (e.g., 158 or 178) outside of the duct (e.g., 63 or 73) and attaching the first portion (e.g., 157 or 177) to the duct (e.g., 63 or 73), for instance, with multiple fasteners that pass through the multiple fourth holes (e.g., 154) and attach to (e.g., screw into) the wall of the duct (e.g., 63 or 73). Moreover, in the embodiment shown, the first portion (e.g., 157 or 177) is actually performing the function of sealing the opening (e.g., 631) in the duct (e.g., 63 or 73). In these embodiments, the first portion (e.g., 157 or 177) is configured to seal an opening (e.g., 631) in the wall of the duct (e.g., 63 or 73) by having a shape that corresponds to the opening (e.g., both being flat or planar) and by being large enough to cover the opening (e.g., 631) and allow space for fasteners to be used through holes 154. In some embodiments, the first portion may be further configured with a gasket or adhesive to provide a better seal. Further, in some embodiments, the first portion and the opening (e.g., 631) in the wall of the duct may both be rectangular. In other embodiments, however, the first portion may be rectangular and the opening (e.g., 631) in the wall of the duct may be round, rectangular with rounded corners, square, or oval, as other examples.

Even further, in the embodiments illustrated, apparatuses 150 and 170 are configured to permit the tubing (e.g., condensate drain line 164 or 165) to penetrate the wall of the duct (e.g., 63 or 73) though first hole, then bend downward through second hole 152, and then bend upward, looping substantially 360 degrees around, to extend downward through third hole 153, forming helical loop 1641 or 1651 in the tubing (e.g., 164 or 165) with (i.e., the loop having) a substantially horizontal axis. In the embodiments shown, this loop 1641 or 1651 serves as a trap in the tubing (e.g., condensate drain line 164 or 165), for example, preventing air, combustion gasses from the furnace (e.g., HVAC unit 1), or sewer gasses from passing through the tubing (e.g., condensate drain line 164 or 165). As mentioned, such a trap (e.g., loop 1641 or 1651) also avoids the formation of a higher static pressure within the drain line (e.g., condensate drain line 164 or 165, for instance, below drain line opening 1012) that would interfere with proper drainage from collector 101, through drain line opening 1012, into the drain line (e.g., condensate drain line 164 or 165). In other embodiments, a trap may be formed in with a different number of holes in the apparatus, such as 2 or 4 holes. For instance, in some embodiments the tube may pass substantially horizontally through the first hole in the apparatus, and then may bend upward looping substantially 270 degrees around to extend downward through the second or third hole forming helical loop in the tubing with a substantially horizontal axis. As another example, in some embodiments the tube may pass substantially horizontally through the first hole in the apparatus, and then may bend upward looping substantially 270 degrees around to extend downward through the second hole, and then may bend upward, looping substantially 360 degrees around, to extend downward through third hole, forming two helical loops in the tubing with a substantially horizontal axis.

Moreover, in the embodiments depicted, the first portion (e.g., 157 or 177) is larger than the second portion (e.g., 158 or 178). Additionally, some embodiments further include, for example, a first grommet at first hole 151, a second grommet at second hole 152, a third grommet at third hole 153, or a combination thereof. In a number of embodiments, the first grommet, the second grommet, the third grommet, or a combination thereof, are (e.g., all) configured to protect the tubing (e.g., condensate drain line 164 or 165) from being damaged by edges of first hole 151, second hole 152, or third hole 153. The grommets may be so configured by having surfaces that contact the tubing that are larger or less sharp than holes 151, 152, and 153, for example. The grommets may also (or instead) provide a better seal around the tubing (e.g., at first hole 151) may help to grip the tubing better (e.g., at third hole 153), or a combination thereof. Such grommets may be plastic, for example. In some embodiments, the grommets may be made of an elastomeric material or rubber. An example of a grommet is grommet 1636 shown in FIG. 6*a*. The grommets at holes 151, 152, and 153 may be the same as or similar to grommet 1636, for example.

Furthermore, some embodiments may further include the tubing (e.g., condensate drain line 164 or 165), for example, which passes though first hole 151, then bends and passes through second hole 152, and then bends and loops 360 degrees around to extend through third hole 153 forming the helical loop (e.g., 1641 or 1651). In the embodiments shown and described, the tubing is a drain line (e.g., condensate drain line 164 or 165) for the HVAC unit (e.g., 1) and the tubing extends from the HVAC unit, through the duct (e.g., 63 or 73), and penetrates the wall of the duct though first hole 151, then bends downward through second hole 152, and then bends upward looping substantially 360 degrees around, and then extends downward through third hole 153 forming the helical loop in the tubing with a substantially horizontal axis that serves as a trap in the tubing. Still further, in some embodiments, the apparatus may include, for example, the HVAC system including, for instance, the duct (e.g., 63 or 73), the HVAC unit (e.g., HVAC unit 1), or both. In the embodiments shown, duct 63 and 73 are return ducts delivering air to the HVAC unit. Further, ducts 63 and 73 are the ducts that have the wall that has the opening (e.g., 631 shown in FIG. 19) that is sealed by first portion 157 or 177 of the apparatus (e.g., 155 or 175) with second portion 158 or 178 outside of the duct.

Further, the embodiments in which the condensate is taken from the collector (e.g., 101) on the suction side of inducer fan (e.g., 104), may be installed at ground level in some applications. For example, FIG. 17 illustrates an embodiment in which horizontal ducts 73 and 72 connect the unit to the building. In the embodiment illustrated, condensate drain line 165 is routed through return duct 71 and 73. In this particular embodiment, drain line 165 exits duct 73 at a distance from the unit. Such an exit may be within the building, for example, to prevent trap 1651 from freezing. In other embodiments, the condensate drain line and trap may be kept from freezing in another way. Examples include locating the trap in the duct or heating the trap to prevent freezing. In some embodiments, the trap may be allowed to freeze if the HVAC unit is not used for a long period, but may be located within the duct (e.g., in return duct 73) or heated sufficiently that the trap will thaw quickly when the unit is started. In climates where freezing occurs, however, the trap frequently used in embodiments that drain the condensate from drain opening 1012 in collector 101 poses a freezing risk that is not found in embodiments such as air conditioning unit 2 shown in FIGS. 7-9, 14, and 22-23. For this reason, the embodiment shown in FIGS. 7-9, 14, and 22-23 may be preferable for discharging condensate into the ground in climates where freezing is a concern.

As mentioned previously, in a number of embodiments, HVAC units are configured for installation at ground level and are also configured for installation on a roof of a building. For example, HVAC units 1, 2, or 3 that include collector 101 shown in FIGS. 20-25 are configured for installation at ground level (e.g., 80 shown in FIG. 9) and are also configured for installation on a roof (e.g., 4 shown in FIGS. 1-6) of a building. As shown in FIGS. 1-6, 10-13, 15-21, and 28-31, unit 1 or 3 can be installed on a roof of a building by attaching a drain line 160, 161, 162, 163, 164, or 165, to drain line opening 1012 penetrating collector 101 (e.g., using fitting 102) and routing the drain line for disposal into a sewer (e.g., as described, in a number of embodiments, herein). Thus, HVAC unit 1 is configured for installation on a roof of a building at least, for example, by providing drain line opening 1012 penetrating collector 101. In some embodiments, HVAC unit 1 is further configured for installation on a roof of a building by providing other components or adaptations described herein, such as the drain line (e.g., 163 shown in FIG. 10), a conduit for the drain line (e.g., 1622 shown in FIGS. 6 and 13, 1612 shown in FIG. 11, or 135 shown in FIGS. 10, 15-18, and 28-31), a hole in the floor (e.g., 112) of the enclosure (e.g., 10) for a drain line or drain line conduit (e.g., hole 1635 shown in FIGS. 6, 6*a*, and 11-13), other components described herein used specifically for installation on a roof (e.g., 4), or a combination thereof.

Moreover, HVAC units 1, 2, or 3 that include collector 101 shown in FIGS. 20-25 are also configured for installation at ground level (e.g., 80 shown in FIG. 9) by installing or leaving installed plug 203 (e.g., shown in FIGS. 24 and 25) in fitting 102, or the combination thereof in drain line opening 1012 of collector 101, and allowing condensate to pass through drain hole 1011 (shown, for example, in FIGS. 21, 23, and 24) extending through collector 101 to the inlet (e.g., 1016) of inducer fan 104. The condensate may then travel through inducer fan 104, through exhaust conduit 506 (e.g., part of exhaust conduit or exhaust and drainage assembly 500), and out of the enclosure (e.g., 20) with the combustion gasses. Thus, the HVAC unit (e.g., 1 or 2) is configured for installation at ground level (e.g., 80 shown in FIG. 9) at least, for example, by providing drain hole 1011 extending through collector 101 to the inlet (e.g., 1016) of inducer fan 104. Other embodiments may be configured for installation at ground level by allowing condensate to pass into inducer fan 104 via exhaust hole 1013 for inducer fan 104, as another example. In some embodiments, HVAC unit 2 is further configured for installation at ground level by providing other components or adaptations described herein, such as plug 203, tee or bifurcation 507, high path 508 and low path 57, standpipe 54, or the bed of neutralizing media or porous alkaline material 82.

As mentioned, in some embodiments, when air conditioning unit 1 or 2 is installed and leveled properly in accordance with the manufacturer's installation instructions, drain hole 1011 is higher than drain line opening 1012. In certain embodiments, drain hole 1011 acts as an overflow for drain line opening 1012. Thus, if drain line opening 1012, fitting 102, the drain line (e.g., 160, 161, 162, 163, 164, or 165) is plugged, the unit may still operate, but condensate may pass through drain hole 1011 and inducer fan 104, and may be exhausted with the combustion gasses. Depending on the routing of the drain line, under freezing conditions, the drain line may be plugged with frozen condensate, for example, and may unplug on its own later when ambient temperatures increase. Further, in some embodiments, the drain line may freeze when the unit is turned off for an extended period under sufficiently cold conditions, but may thaw out after the unit has been operating in a heating mode for a sufficient period of time, as another example.

When drain hole 1011 acts as an overflow, and condensate is not able to drain though opening 1012, if ambient conditions are below freezing, ice may form beside the unit, for example, on the roof or on the ground. If such ice only forms for a short time, however, such ice formation may not be problematic. In some instances, the ice formation, or water if conditions are warmer, may serve to warn the owner or user of the unit that the drain line is plugged. Further, some embodiments may omit drain hole 1011, and instead, exhaust hole 1013 for inducer fan 104, may perform the role of drain hole 1011. In the embodiment illustrated, exhaust hole 1013 is also higher than drain line opening 1012 and extends through collector 101 to inlet 1016 of inducer fan 104. Thus, in such embodiments, exhaust hole 1013 may act as an overflow for drain line opening 1012. Further, in embodiments that have a drain hole 1011, exhaust hole 1013 may act as an overflow for drain hole 1011. In embodiments that have a drain hole 1011, however, drain hole 1011 may reduce the amount of condensate that will accumulate in the collector (e.g., in collector 101 with plug 203 installed in drain line opening 1012 rather than a drain line attached thereto). An accumulation of condensate in the collector could freeze, for example, if the unit is turned off for an extended period when ambient conditions are sufficiently below freezing.

Figure 32:
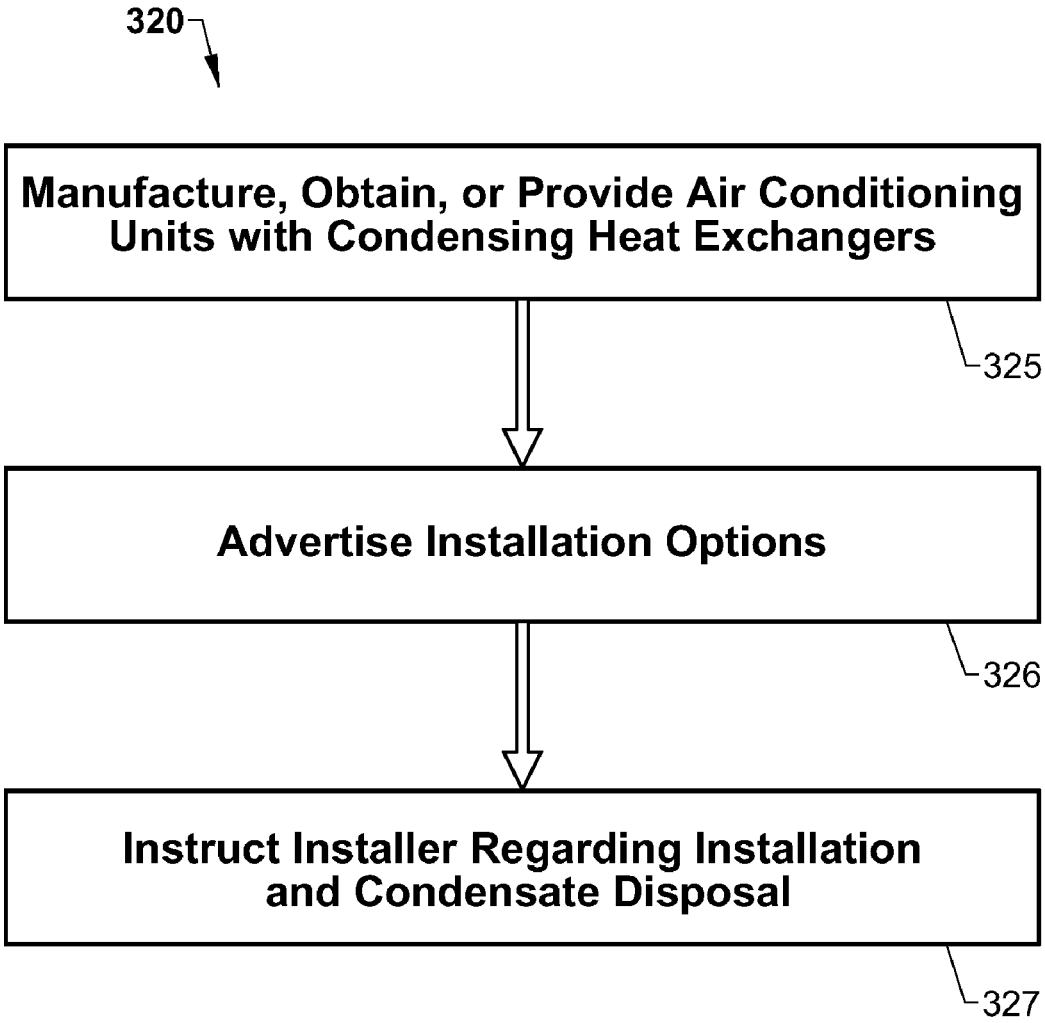
FIG. 32 is a flow chart illustrating, among other things, a method of reducing fuel consumption from widely used HVAC equipment by manufacturing, obtaining, or providing condensing gas package units and advertising installation options (e.g., that they can be installed on a roof or on the ground).

Still other embodiments include particular methods, for example, of reducing consumption of fossil fuels, of reducing emission of greenhouse gasses, or both, for instance. Such reductions may be significant, for example, because they are from HVAC equipment that is widely used. FIG. 32 illustrates an example of such a method, method 320, of reducing consumption of fossil fuels from widely used HVAC equipment (e.g., air conditioning units with gas furnaces or gas package units). Method 320 includes certain acts that are shown in FIG. 32, described herein, or both, which may be performed in the order indicated or in another order. These acts may include, for example, act 325 of manufacturing, obtaining, or providing air conditioning units that have condensing heat exchangers, act 326 of advertising installation options, and act 327 of instructing installers of the air conditioning units regarding installation of those units and condensate disposal. Various embodiments may include some or all of these acts.

In a number of embodiments, act 325 includes manufacturing, obtaining, or providing air conditioning units with condensing (e.g., gas) heat exchanger such as units 1, 2, or 3 described herein, for example. Further, in various embodiments, act 326 may include advertising that the air conditioning units (e.g., with condensing heat exchangers) can be installed on a roof of a building and condensate from the condensing gas heat exchangers (e.g., 300) can be disposed of by routing a drain line (e.g., 160, 161, 162, 163, 164, or 165) through the roof (e.g., 4) of the building for disposal, for example, inside the building. Moreover, in many embodiments, act 326 may include advertising that the air conditioning units can be installed at ground level (e.g., 80 shown in FIG. 9 or on slab 5 shown in FIGS. 7-9) and condensate from the condensing gas heat exchangers (e.g., 300) can be disposed of into the ground (e.g., via standpipe 54 shown in FIGS. 22 and 23). Advertising may be performed, for example, using sales persons, through printed material or sales literature, through one or more Internet websites, through Internet advertisements displayed on websites of others, by blogging on the Internet, by direct mail, by e-mail, in catalogues, through broadcast media such as radio or television, on YouTube, through Internet-based networking sites such as Facebook or LinkedIn, through printed periodicals such as magazines or newspapers, via online periodicals, by telephone, via call centers, through distributors, or on product packaging, as examples, or a combination thereof.

In some embodiments, the act (e.g., 325) of manufacturing, obtaining, or providing the air conditioning units (e.g., 1, 2, or 3) includes manufacturing, obtaining, or providing air conditioning units that include a condensing (e.g., gas) heat exchanger (e.g., 300 shown in FIG. 26) having at least one stage (e.g., stage 312) that has fins, a collector (e.g., 101 shown in FIGS. 20-24) connected to the (e.g., at least one) stage (e.g., 312) that has fins, and an inducer fan (e.g., 104 shown in FIGS. 20-23) having an inlet (e.g., 1016) connected to the collector (e.g., 101). In a number of embodiments, the collector (e.g., 101) has a drain line opening (e.g., 1012) penetrating the collector. Moreover, in particular embodiments, act 325 of manufacturing, obtaining, or providing the air conditioning units includes manufacturing, obtaining, or providing units that include a drain hole (e.g., 1011) extending through the collector (e.g., 101) to the inlet (e.g., 1016) of the inducer fan (e.g., 104). In a number of embodiments, the drain hole (e.g., 1011) is higher (e.g., when the unit is properly installed and level) than the drain line opening (e.g., 1012).

Further, in some embodiments, act 327 includes instructing an installer of the units that when they install the unit at ground level (e.g., 80 shown in FIG. 9) and dispose of condensate from the condensing gas heat exchanger into the ground (e.g., as shown in FIGS. 7-9 and 14), that they can leave in place, or install, a plug (e.g., plug 203 shown in FIGS. 22, 24, and 25) in the drain line opening (e.g., 1012, or in fitting 102) penetrating the collector (e.g., 101) and allow the condensate to pass through the inducer fan (e.g., 104). As used herein, instructing (e.g., in act 327) an installer that they "can" do a certain act includes doing one or both of: instructing the installer to perform the act, or instructing the installer that performing the act is an option. Further, as used herein, instructing (e.g., in act 327) an installer that they "can" provide certain components or a particular configuration includes doing one or more of: instructing the installer to provide the certain components or the particular configuration, instructing the installer that providing the certain components or the particular configuration is an option, or showing the certain components or the particular configuration in an illustration such as a drawing, picture, or video.

Moreover, in some embodiments act 327 includes instructing an installer of the units that when they install the unit on the roof (e.g., 4) of the building and dispose of condensate from the condensing (e.g., gas) heat exchanger (e.g., 300), for instance, in the building (e.g., as shown, in different embodiments, in FIGS. 1-6, 11-13, 15-19, and 28-29), that they can leave attached, or attach, the drain line (e.g., 160, 161, 162, 163, 164, or 165) to the opening (e.g., 1012, or to fitting 102) penetrating the collector (e.g., 101). In some embodiments, act 327 may also include instructing the installer that they can route the drain line (e.g., 160, 161, 162, 163, 164, or 165) through the roof (e.g., 4), and allow the condensate to pass through the drain line for disposal inside the building. In various embodiments, an installer may be instructed (e.g., in act 327) via written instructions provided with the unit, though a website, by e-mail, through an instructional video, by instructions provided on product packaging, through training classes, through a technical service call center, or a combination thereof, as examples. Further, although shown in FIG. 32 as one act 327, various information conveyed to installers may be conveyed in the same or separate acts, in different embodiments. Still further, various information described herein as being conveyed to installers in separate acts may be conveyed in the same act.

Even further, in some embodiments act 327 includes instructing an installer of the units that when they install the unit on the roof (e.g., 4) of the building and dispose of condensate from the condensing gas heat exchanger in the building, that they can provide a trap (e.g., 1601, 1611, 1621, 1641 or 1651 shown in FIGS. 1-4, 11-13, 16, 17, 19, 28, and 30) in the drain line (e.g., 160, 161, 162, or 164) inside the building. In embodiments where a drain line is attached to the collector (e.g., 101, at opening 1012, for instance, via fitting 102) the trap may keep air from within the building or sewer gasses from traveling up through the drain line and out through the inducer fan (e.g., 104). Air or sewer gasses traveling up through the drain line and out through the inducer fan (e.g., 104) may prevent condensate from draining through the drain line, in some embodiments.

Still further, in some embodiments act 327 may include instructing an installer of the units that when they install the unit on the roof (e.g., 4) of the building and dispose of condensate from the condensing (e.g., gas) heat exchanger (e.g., 300) in the building, that they can install the unit on a roof curb assembly (e.g., 45 shown in FIG. 6) and route the drain line (e.g., 162) through a tubular conduit (e.g., 1622) that passes through the roof curb assembly and through the roof of the building. Further, in certain embodiments, act 327 may include instructing an installer of the units that when they install the unit on the roof of the building and dispose of condensate from the condensing gas heat exchanger in the building, that they can route the drain line (e.g., 163 or 164) through the roof (e.g., 4) of the building inside of a return duct (e.g., 63) that connects to the unit to deliver air from within the building to the unit. Examples of such a configuration are shown in FIGS. 16, 18, 19, and 28-31).

In a number of embodiments, act 325 of manufacturing, obtaining, or providing the air conditioning units includes manufacturing, obtaining, or providing air conditioning units that include a return duct opening (e.g., 296 or 171 shown in FIGS. 10-19, 28, and 29) for connecting the unit to a return duct (e.g., 61, 63, or 71)) that delivers air to the unit (e.g., 1 or 2) from the building. In particular embodiments, the drain line (e.g., 163, 164, or 165) is connected to the unit (e.g., to opening 1012 or fitting 102) to receive the condensate and the drain line extends to the return duct opening (e.g., 296 or 171) and is stored at the return duct opening during shipment of the unit (e.g., as shown in FIGS. 10 and 15). This configuration may be, for instance, for routing the drain line (e.g., 163, 164, or 165) through the return duct (e.g., 61, 63, or 71) when the unit is installed on the roof (e.g., 4) of the building. Further, in some embodiments, act 325 of manufacturing, obtaining, or providing the air conditioning units may include manufacturing, obtaining, or providing air conditioning units that include (e.g., besides the return duct opening, such as 296 or 171, for connecting the unit to a return duct, such as 61, 63, or 71, that delivers air to the unit from the building) a tubular conduit (e.g., 135 shown in FIGS. 15-18 and 28-31 that extends to the return duct opening (e.g., 296 or 171). This conduit (e.g., 135) may be for routing the drain line (e.g., 164 or 165) through the return duct (e.g., 63 or 71) when the unit is installed on the roof (e.g., 4) of the building or when the unit is mounted at ground level (e.g., 80), as examples.

Some embodiments may further include, for example, in act 327, instructing an installer of the units (e.g., 2) that when they install the unit at ground level (e.g., as shown in FIGS. 7-9) and dispose of condensate from the condensing (e.g., gas) heat exchanger (e.g., 300) into the ground, that they can install a bifurcation (e.g., 507 shown in FIGS. 22 and 23) in an exhaust conduit or exhaust and drainage assembly (e.g., 500) extending from an outlet (e.g., 105) of an inducer fan (e.g., 104) of the unit to outside of an enclosure (e.g., 20 shown in FIGS. 7-9) for the unit. In a number of embodiments, this act (e.g., act 327 or part thereof) may include instructing that the bifurcation (e.g., 507) can be installed to provide a high path (e.g., 508) and a low path (e.g., 57), and that the low path can be installed to discharge into a vertical standpipe (e.g., 54), for instance. Further, certain embodiments may include, for example, in act 327, instructing the installer of the units that when they install the unit at ground level (e.g., as shown in FIGS. 7-9) and dispose of condensate from the condensing gas heat exchanger into the ground, that they can provide a low path (e.g., 57) that discharges into a vertical standpipe (e.g., 54) that extends into the ground and terminates with at least one opening (e.g., 52) to the ground below a frost line (e.g., 81) in the ground. Still further, some embodiments may further include, for example, in act 327, instructing an installer of the units that when they install the unit at ground level (e.g., 80 shown in FIG. 9) and dispose of condensate from the condensing gas heat exchanger into the ground, that they can direct the condensate to discharge into a bed of porous alkaline material (e.g., 82) in the ground, for example, to neutralize acidity of the condensate.

Various methods may further include acts of obtaining, providing, or making various components described herein or known in the art. Other embodiments include a building that includes an air conditioning unit or HVAC unit or system described herein. Various methods in accordance with different embodiments include acts of selecting, making, positioning, or using certain components, as examples. Other embodiments may include performing other of these acts on the same or different components, or may include fabricating, assembling, obtaining, providing, ordering, receiving, shipping, or selling such components, or other components described herein or known in the art, as other examples. Further, various embodiments include various combinations of the components, features, and acts described herein or shown in the drawings, for example. Further, particular embodiments include various means for accomplishing one or more of the particular functions described herein or apparent from the structure described. Other embodiments may be apparent to a person of ordinary skill in the art having studied this document.

What is claimed is:

1. An air conditioning unit packaged with a condensing gas heat exchanger for heating a space within a building, the unit comprising:

a return duct opening for connecting the unit to a return duct that delivers air to the unit from the space within the building;

a supply duct opening for connecting the unit to a supply duct that delivers air from the unit to the space within the building;

the condensing gas heat exchanger for heating the air;

a collector connected to the condensing gas heat exchanger;

an inducer fan having an inlet connected to the collector;

a drain line opening penetrating the collector;

a condensate drain line connected to the drain line opening penetrating the collector, wherein the condensate drain line extends to the return duct opening for routing through the return duct for disposal of the condensate;

a tubular conduit through which the condensate drain line passes between the drain line opening penetrating the collector and the return duct opening;

an outdoor section wherein the condensate drain line passes through the outdoor section and the tubular conduit protects the condensate drain line from freezing where the condensate drain line passes through the outdoor section;

a heating section containing the condensing gas heat exchanger;

a return section containing the return duct opening;

an interstitial space between the condensate drain line and the tubular conduit;

an inlet passageway from the heating section to the interstitial space; and an outlet passageway from the interstitial space to the return section; and wherein air is allowed to flow from the heating section, through the inlet passageway, through the interstitial space along the condensate drain line, and out the outlet passageway to the return section to keep the condensate drain line from freezing where the condensate drain line passes through the outdoor section.

2. The air conditioning unit of claim 1 wherein the condensate drain line passes through the heating section and the tubular conduit protects the condensate drain line from direct heat from the condensing gas heat exchanger where the condensate drain line passes through the heating section.

3. The air conditioning unit of claim 1 wherein the condensate drain line attaches to the drain line opening penetrating the collector in the outdoor section.

4. The air conditioning unit of claim 3 wherein, after the condensate drain line attaches to the drain line opening penetrating the collector, the condensate drain line passes into the heating section.

5. The air conditioning unit of claim 1 wherein the condensate drain line passes through the heating section, then through the outdoor section, and then into the return section.

6. An air conditioning unit packaged with a condensing gas heat exchanger for heating a space within a building, the unit comprising:

a return duct opening for connecting the unit to a return duct that delivers air to the unit from the space within the building;

a supply duct opening for connecting the unit to a supply duct that delivers air from the unit to the space within the building;

the condensing gas heat exchanger for heating the air;

a collector connected to the condensing gas heat exchanger;

an inducer fan having an inlet connected to the collector;

a drain line opening penetrating the collector;

a tubular conduit for passing a condensate drain line, wherein the tubular conduit extends from proximate the drain line opening penetrating the collector to the return duct opening for routing the condensate drain line from the drain line opening penetrating the collector to the return duct opening and through the return duct for disposal of the condensate;

an outdoor section wherein the tubular conduit passes through the outdoor section;

a heating section containing the condensing gas heat exchanger;

a return section containing the return duct opening;

an interstitial space inside the tubular conduit;

an inlet passageway from the heating section to the interstitial space; and an outlet passageway from the interstitial space to the return section;

wherein, when the unit is operating, air flows from the heating section, through the inlet passageway, through the interstitial space, and out the outlet passageway to the return section.

7. The air conditioning unit of claim 6 wherein the tubular conduit passes through the heating section and the tubular conduit protects the condensate drain line therein from direct heat from the condensing gas heat exchanger where the tubular conduit passes through the heating section.

8. The air conditioning unit of claim 6 wherein, when the unit is operating, air flows from the heating section, through the inlet passageway, through the interstitial space along the condensate drain line therein, and out the outlet passageway to the return section to keep the condensate drain line from freezing where the condensate drain line passes through the outdoor section.

9. The air conditioning unit of claim 6 wherein the drain line opening penetrating the collector is in the outdoor section and the tubular conduit extends from the outdoor section to the return duct opening.

10. The air conditioning unit of claim 6 wherein the tubular conduit passes through the heating section, then through the outdoor section, and then to the return section.

11. An air conditioning unit packaged with a condensing gas heat exchanger, the unit comprising:

a return duct opening for connecting the unit to a return duct;

a return section containing the return duct opening;

a supply duct opening for connecting the unit to a supply duct;

the condensing gas heat exchanger for heating air;

a collector connected to the condensing gas heat exchanger;

a drain line opening penetrating the collector;

a condensate drain line connected to the drain line opening penetrating the collector;

a tubular conduit through which the condensate drain line passes between the drain line opening penetrating the collector and the return duct opening;

an interstitial space between the condensate drain line and the tubular conduit;

an inlet passageway to the interstitial space; and an outlet passageway from the interstitial space to the return section wherein air flows through the inlet passageway, through the interstitial space along the condensate drain line, and out the outlet passageway to keep the condensate drain line from freezing.

12. The air conditioning unit of claim 11 wherein the condensate drain line extends to the return duct opening for routing the drain line through the return duct for disposal of the condensate.

13. The air conditioning unit of claim 11 further comprising a heating section containing the condensing gas heat exchanger wherein the condensate drain line passes through the heating section and the tubular conduit protects the condensate drain line from direct heat from the condensing gas heat exchanger where the condensate drain line passes through the heating section.

14. The air conditioning unit of claim 11 further comprising an outdoor section wherein the condensate drain line passes through the outdoor section and the tubular conduit protects the condensate drain line from freezing where the condensate drain line passes through the outdoor section.

15. The air conditioning unit of claim 11 further comprising a heating section containing the condensing gas heat exchanger, wherein the inlet passageway extends from the heating section to the interstitial space and air flows from the heating section, through the inlet passageway, through the interstitial space along the condensate drain line, and out the outlet passageway to keep the condensate drain line from freezing.

16. The air conditioning unit of claim 11 further comprising an outdoor section, wherein the condensate drain line attaches to the drain line opening penetrating the collector in the outdoor section.

17. The air conditioning unit of claim 16 further comprising a heating section containing the condensing gas heat exchanger, wherein, after the condensate drain line attaches to the drain line opening penetrating the collector, the condensate drain line passes into the heating section.

18. The air conditioning unit of claim 11 further comprising an outdoor section and a heating section containing the condensing gas heat exchanger, wherein the condensate drain line passes through the heating section, then through the outdoor section, and then into the return section.

* * * * *